US009680204B2

(12) United States Patent
Aoki et al.

(10) Patent No.: US 9,680,204 B2
(45) Date of Patent: Jun. 13, 2017

(54) ANTENNA DEVICE

(71) Applicant: CASIO COMPUTER CO., LTD., Shibuya-ku, Tokyo (JP)

(72) Inventors: Yutaka Aoki, Ome (JP); Shigeru Yagi, Tokyo (JP); Kaoru Yoshida, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 134 days.

(21) Appl. No.: 14/222,504

(22) Filed: Mar. 21, 2014

(65) Prior Publication Data

US 2014/0285385 A1 Sep. 25, 2014

(30) Foreign Application Priority Data

Mar. 22, 2013 (JP) ..... 2013-059429

(51) Int. Cl.
*H01Q 1/38* (2006.01)
*H01Q 1/24* (2006.01)
(Continued)

(52) U.S. Cl.
CPC ..... *H01Q 1/243* (2013.01); *H01Q 1/273* (2013.01); *H01Q 5/378* (2015.01); *H01Q 5/385* (2015.01); *H01Q 1/2283* (2013.01)

(58) Field of Classification Search
CPC ..... H01Q 9/40; H01Q 9/42; H01Q 19/005; H01Q 5/378; H01Q 5/385; H01Q 1/245;
(Continued)

(56) References Cited

U.S. PATENT DOCUMENTS 4,419,770 A * 12/1983 Yagi ..... G04B 47/025 368/10
4,769,656 A * 9/1988 Dickey ..... H01Q 1/44 224/175
(Continued)

FOREIGN PATENT DOCUMENTS

CN 1140342 A 1/1997
CN 1473375 A 2/2004
(Continued)

OTHER PUBLICATIONS

Japanese Office Action (and English translation thereof) dated Jun. 18, 2015, issued in counterpart Japanese Application No. 2013-059429.
(Continued)

*Primary Examiner* — Dameon E Levi
*Assistant Examiner* — Awat Salih
(74) *Attorney, Agent, or Firm* — Holtz, Holtz & Volek PC

(57) ABSTRACT

An antenna device of the present invention includes an antenna element which transmits or receives an electromagnetic wave having a specific frequency by being supplied with electric power, a conductive element which is formed of a conductive material, arranged so as to be spaced apart from and face the antenna element, and serves as a parasitic element, and a housing having a sealed space therein. The antenna element is provided inside the housing, and the conductive element is provided on outer surface of the housing, or in inner part of the housing, or in a mount member by which the housing is worn on a human body, or in a holding member for holding the housing; the conductive element is electromagnetically coupled to the antenna element, resonates with the specific frequency; and transmits or receives the electromagnetic wave.

7 Claims, 22 Drawing Sheets

(51) Int. Cl.

| | |
|---|---|
| ***H01Q 1/27*** | (2006.01) |
| ***H01Q 5/378*** | (2015.01) |
| ***H01Q 5/385*** | (2015.01) |
| *H01Q 1/40* | (2006.01) |
| *H01Q 1/22* | (2006.01) |

(58) Field of Classification Search

CPC H01Q 1/273; H01Q 1/27; H01Q 1/40; H01Q 1/38; H01Q 1/241–1/243; H01Q 19/26; H01Q 19/32; H01Q 5/49; H01Q 5/392; H04M 1/0214; G04B 37/005

USPC ..... 343/702, 833, 834, 718, 873; 455/575.3; 368/281, 282, 283, 286, 40

See application file for complete search history.

(56) References Cited

U.S. PATENT DOCUMENTS

| | | | | | |
|---|---|---|---|---|---|
| 4,884,252 | A * | 11/1989 | Teodoridis | H01Q 1/44 | 343/718 |
| 4,922,260 | A * | 5/1990 | Gaskill | H01Q 1/273 | 343/718 |
| 5,564,082 | A * | 10/1996 | Blonder | G04G 21/04 | 343/718 |
| 5,742,256 | A * | 4/1998 | Wakabayashi | H01Q 1/273 | 224/178 |
| 5,768,217 | A * | 6/1998 | Sonoda | G04B 47/025 | 343/718 |
| 5,886,669 | A * | 3/1999 | Kita | H01Q 1/273 | 343/700 MS |
| 7,009,567 | B2 * | 3/2006 | Iwai | H01Q 1/24 | 343/702 |
| 7,215,600 | B1 * | 5/2007 | DeRosa | G04G 21/04 | 343/718 |
| 7,457,650 | B2 * | 11/2008 | Iwai | H01Q 1/242 | 343/702 |
| 8,208,980 | B2 | 6/2012 | Wong et al. | | |
| 8,442,602 | B2 | 5/2013 | Wong et al. | | |
| 8,610,634 | B2 * | 12/2013 | Aoki | H01Q 1/38 | 343/795 |
| 8,698,677 | B2 * | 4/2014 | Bungo | H01Q 1/243 | 343/702 |
| 8,750,948 | B2 | 6/2014 | Wong et al. | | |
| 8,982,000 | B2 * | 3/2015 | Kim | G04R 60/12 | 343/702 |
| 9,287,915 | B2 | 3/2016 | Wong et al. | | |
| 2001/0050643 | A1 * | 12/2001 | Egorov | H01Q 1/243 | 343/702 |
| 2004/0032370 | A1 | 2/2004 | Ito et al. | | |
| 2004/0222930 | A1 * | 11/2004 | Sun | A44C 5/0007 | 343/718 |
| 2005/0062665 | A1 * | 3/2005 | du Toit | E21B 7/04 | 343/789 |
| 2005/0237254 | A1 * | 10/2005 | Kato | H01Q 1/273 | 343/788 |
| 2005/0275596 | A1 * | 12/2005 | Harano | H01Q 1/243 | 343/702 |
| 2006/0001583 | A1 * | 1/2006 | Bisig | H01Q 7/00 | 343/718 |
| 2006/0017624 | A1 * | 1/2006 | Nagano | H01Q 1/243 | 343/702 |
| 2006/0183515 | A1 * | 8/2006 | Iguchi | H01Q 1/245 | 455/575.3 |
| 2007/0030154 | A1 * | 2/2007 | Aiki | H01Q 9/0485 | 340/572.7 |
| 2007/0109208 | A1 * | 5/2007 | Turner | H01Q 1/273 | 343/718 |
| 2007/0146218 | A1 * | 6/2007 | Turner | H01Q 1/273 | 343/718 |
| 2007/0194066 | A1 * | 8/2007 | Ishihara | A44C 5/0015 | 224/164 |
| 2010/0033383 | A1 * | 2/2010 | Yamamoto | H01Q 19/24 | 343/702 |
| 2011/0248895 | A1 | 10/2011 | Bungo et al. | | |
| 2012/0038516 | A1 * | 2/2012 | Hsieh | H01Q 1/243 | 343/702 |
| 2012/0122519 | A1 * | 5/2012 | Jochheim | H04B 1/385 | 455/556.1 |
| 2012/0218162 | A1 | 8/2012 | Aoki et al. | | |
| 2013/0016016 | A1 * | 1/2013 | Lin | H01Q 1/273 | 343/702 |
| 2014/0009355 | A1 * | 1/2014 | Samardzija | H01Q 1/42 | 343/789 |
| 2015/0341476 | A1 * | 11/2015 | Hogue | G04R 60/04 | 455/575.7 |

FOREIGN PATENT DOCUMENTS

| | | | |
|---|---|---|---|
| CN | 101800354 | A | 8/2010 |
| JP | 09036630 | A | 2/1997 |
| JP | -2011061622 | * | 9/2009 |
| JP | 2011061622 | A | 3/2011 |
| JP | 2011-176495 | A | 9/2011 |
| JP | 2011-208945 | A | 10/2011 |
| WO | WO 2011/105057 | A1 | 9/2011 |

OTHER PUBLICATIONS

Chinese Office Action (and English translation thereof) dated Nov. 23, 2015, issued in counterpart Chinese Application No. 201410108236.7.

Chinese Office Action (and English translation thereof) dated Jul. 5, 2016, issued in counterpart Chinese Application No. 201410108236.7.

Japanese Office Action (and English translation thereof) dated Dec. 20, 2016, issued in counterpart Japanese Application No. 2016-011981.

* cited by examiner

VIEW FROM LINE IB-IB

VIEW FROM LINE IC-IC

CROSS-SECTION OF IIA PORTION

VIEW FROM LINE VIII B - VIII B

VIEW FROM LINE VIII C - VIII C

XXB-XXB CROSS-SECTION

ANTENNA DEVICE

CROSS-REFERENCE TO RELATED APPLICATION

This application is based upon and claims the benefit of priority from the prior Japanese Patent Application No. 2013-059429, filed Mar. 22, 2013, the entire contents of which are incorporated herein by reference.

BACKGROUND OF THE INVENTION

1. Field of the Invention

The present invention relates to an antenna device and electronic device. Specifically, the present invention relates to an antenna device that is applied in a portable electronic device with a small-sized housing having a wireless communication function.

2. Description of the Related Art

In recent years, portable electronic devices including various wireless communication functions have been significantly widespread.

Among various electronic devices such as smartphones (high-functionality portable telephones), tablet-type terminals, digital cameras, sports watches (running watches), and GPS devices for mountaineering, those having a function for connecting to a public wireless communication circuit (such as a portable telephone circuit or high-speed data communication circuit), a short-range wireless communication function such as a wireless LAN (Local Area Network) or Bluetooth (registered trademark), or a function for position measurement using electromagnetic waves from a GPS (Global Positioning System) satellite have been known.

In particular, recently, because of rising health consciousness or diversification of interest, more and more people are performing daily exercises, such as walking, running, and cycling, to maintain their wellness or improve their health condition, or are interested in spending time in nature by mountaineering, trekking, etc.

Sports watches, electronic devices for outdoor use, and the like to be used in these scenes are required to have high functionality in addition to light weight and small size, including the short-range wireless communication function such as a wireless LAN (Local Area Network) or Bluetooth (registered trademark), the measurement function by GPS, a time correction function, etc.

Currently, various devices addressing these demands have become commercially available.

One of these electronic devices is, for example, a wristwatch-type terminal described in Japanese Patent Application Laid-Open (Kokai) Publication No 2011-208945 which has a structure where a square-shaped patch antenna for receiving electromagnetic waves from a GPS satellite has been arranged substantially at the center in the housing.

In this type of wristwatch-type terminal, many electronic components are required to be incorporated in a small-sized housing. Therefore, the size of its antenna for GPS and various wireless communications has to be decreased. This decrease in size invites degradation in the performance of the wireless communication, such as degradation in electromagnetic-wave transmission and reception characteristics, and narrowing of the band of the electromagnetic waves.

For example, in a case where a square-shaped patch antenna such as that described in Japanese Patent Application Laid-Open (Kokai) Publication No. 2011-208945 is adopted, it is required to consider the size (area and thickness) of the antenna in order to achieve favorable transmission and reception characteristics.

Here, if the size of the antenna is increased to improve the performance, the layout design of peripheral electronic components and the design of the housing of the wristwatch-type terminal (electronic device) may be affected thereby. Also, the size and structural design of the antenna may be restricted if the size of the housing is decreased and the thickness thereof is made thinner, which decreases the performance of the antenna.

SUMMARY OF THE INVENTION

The present invention is capable of narrowing the mounting space of an antenna device that is applied in various wireless communication, GPS, etc., and is capable of providing an antenna device having excellent electromagnetic-wave transmission and reception characteristics and an electronic device including the antenna device, while reducing limitations of design.

In accordance with one aspect of the present invention, there is provided an antenna device comprising: an antenna element which transmits or receives an electromagnetic wave having a specific frequency by being supplied with electric power; a conductive element which is formed of a conductive material, arranged so as to be spaced apart from and face the antenna element, and serves as a parasitic element; and a housing having a sealed space therein, wherein the antenna element is provided inside the housing, wherein the conductive element is provided on an outer surface of the housing, or in inner part of the housing, or in a mount member mounted to the housing, or in a holding member for holding the housing, and wherein the conductive element is electromagnetically coupled to the antenna element, resonates with the specific frequency, and transmits or receives the electromagnetic wave.

In accordance with another aspect of the present invention, there is provided an electronic device comprising: a device body section which has a communication control function for controlling communication with an external device; an antenna element which is supplied with electric power from the device body section, and transmits or receives an electromagnetic wave having a specific frequency for performing the communication; a conductive element which is formed of a conductive material, arranged so as to be spaced apart from and face the antenna element, and serves as a parasitic element; and a housing which has a sealed space therein and houses the device body section, wherein the antenna element is provided inside the housing, wherein the conductive element is provided on an outer surface of the housing, or in inner part of the housing, or in a mount member mounted to the housing, or in a holding member for holding the housing, and wherein the conductive element is electromagnetically coupled to the antenna element, resonates with the specific frequency, and transmits or receives the electromagnetic wave.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIGS. 7A and 78 are diagrams depicting radiation characteristics in the antenna device according to the first embodiment;

DETAILED DESCRIPTION OF THE PREFERRED EMBODIMENTS

Embodiments of an antenna device and an electronic device according to the present invention will hereinafter be described in detail.

<First Embodiment>

Figure 1A:
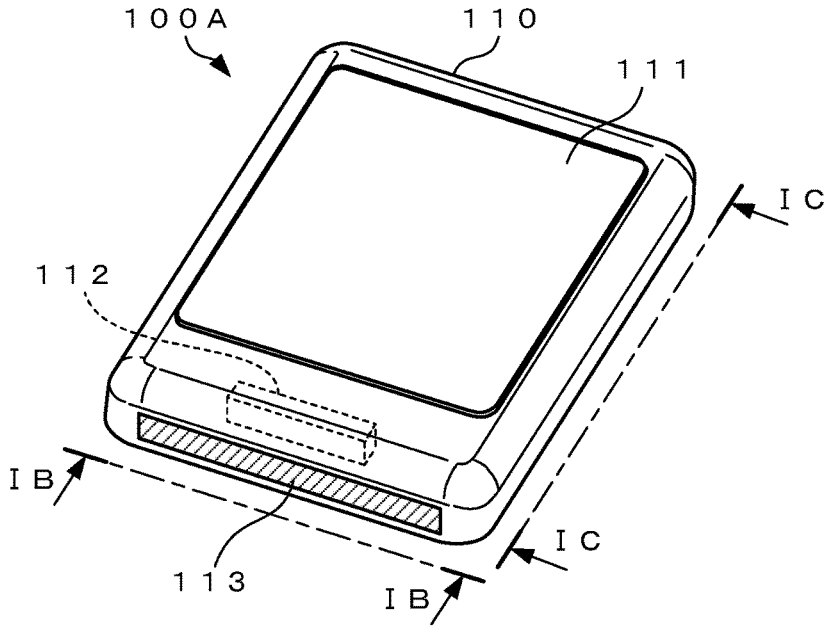
FIGS. 1A, 1B and 1C are schematic structure diagrams depicting a first embodiment in which an antenna device according to the present invention has been applied in an electronic device.
Figure 1B:
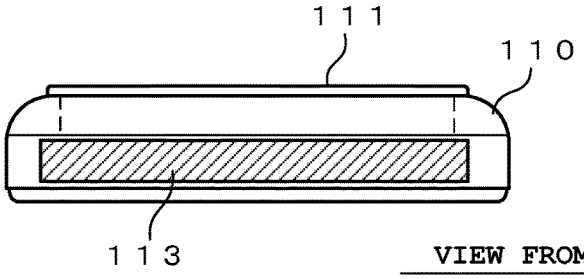
Figure 1C:
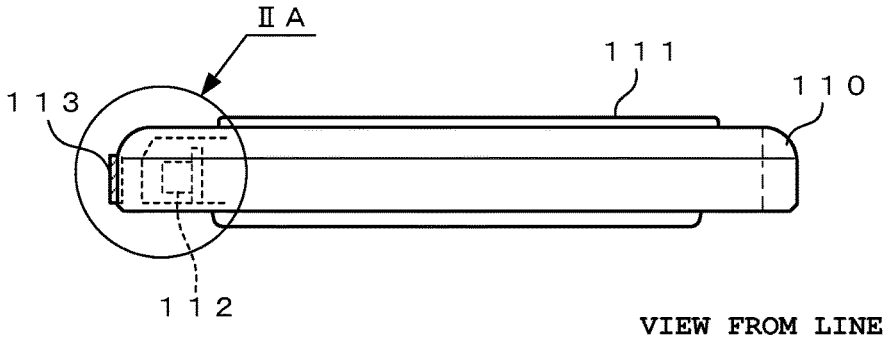

FIGS. 1A, 1B and 1C are schematic structural diagrams depicting a first embodiment in which an antenna device according to the present invention has been applied in an electronic device.

Here. FIG. 1A is a perspective view of the outer appearance structure of the electronic device according to the present embodiment. FIG. 1B is a diagram depicting a side surface of the electronic device when viewed from line IB-IB (for convenience of description, "I" is used herein as a sign corresponding to a Roman numeral of "1" depicted in FIGS. 1A, 1B, and 1C, and the same will apply hereinafter) in FIG. 1A.

FIG. 1C is a diagram depicting a side surface of the electronic device when viewed from line IC-IC in FIG. 1A.

Note that a conductive element in FIGS. 1A, 1B and 1C has been hatched so as to clarify the graphical representation for convenience of reference.

Figure 2A:
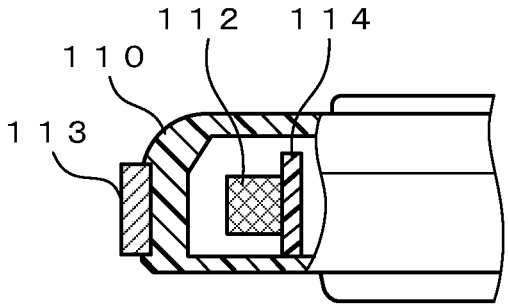
FIGS. 2A, 2B and 2C are enlarged sectional views of the main section of the electronic device according to the first embodiment.
Figure 2B:
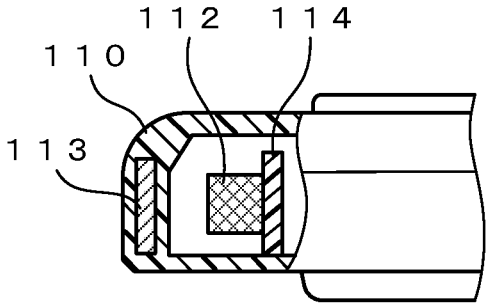
Figure 2C:
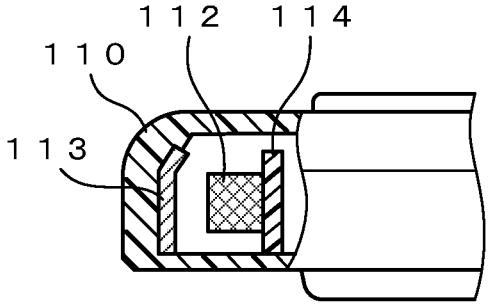

FIGS. 2A, 2B and 2C are enlarged sectional views of the main section of the electronic device according to the present embodiment.

Here, FIG. 2A is an enlarged sectional view of a IIA portion (for convenience of description, "II" is used herein as a sign corresponding to a Roman numeral of "2" depicted in FIGS. 1A, 1B and 1C, and the same will apply hereinafter) depicted in FIG. 1C.

FIG. 2B and FIG. 2B are diagrams depicting other examples of the structure of the IIA portion.

An electronic device 100A according to the first embodiment has, for example, a housing 110 where paired surfaces (the upper surface and the lower surface in the drawing) each having a rectangular plane shape have been arranged opposing each other, as depicted in FIGS. 1A to 1C.

In one surface (the upper surface in the drawing) of the housing 110, for example, a display section 111 is incorporated. On the display section 111, various kinds of information in accordance with the operation and function of the electronic device 100A are displayed.

Inside the housing 110, an antenna element 112 and a device body section 116 are provided.

The electronic device 100A is, for example, a smartphone (high-functionality portable telephone), a tablet-type terminal, a digital camera, a sports watch (running watch), a GPS device for mountaineering, or the like. The device body section 116 has at least a communication control function for transmitting and receiving various data to and from another outside communication device (such as a network device or personal computer) via the antenna element 112, and an information processing function for achieving a predetermined function of the electronic device 100A based on various data to be transmitted and received.

The antenna element 112 is structured to be mounted on an insulating circuit board 114 together with a communication circuit (omitted in the drawing), and is supplied with a predetermined signal from the device body section 116, as depicted in FIG. 2A.

On the outer portion of one side surface (the side surface on the frontward side in FIG. 1A) of the housing 110 facing the antenna element 112, a conductive element 113 is provided along the extending direction of this side surface (the horizontal direction in FIG. 1B).

Here, the antenna device according to the present invention is structured to include at least the antenna element 112 and the conductive element 113 described above.

In the housing 110 of the electronic device 100A, at least a region that faces the antenna element 112 provided inside the housing 110 and is provided with the conductive element 113 and a region near this region (specifically, a side surface portion of the area provided with the conductive element 113 in FIG. 2A and its nearby portion) are formed of an insulating material such as a resin material.

The communication circuit including the antenna element 112 and the circuit board 114 receives a signal from the device body section 116 and, by using a short-range wireless communication technology such as a wireless LAN (Local Area Network) or Bluetooth (registered trademark), achieves a function for transmitting and receiving various data between the electronic device 100A and another outside communication device (such as a network device or personal computer). Also, the communication circuit achieves a function for receiving electromagnetic waves from a GPS satellite and measuring the current position of a user carrying the electronic device 100A, and the like.

In order to achieve a desired communication function, the communication circuit transmits and receives, via the antenna element 112, an electromagnetic wave having a specific frequency in accordance with the currently-used communication technology.

Here, as the antenna element 112, any of various antennas such as those for linear or circular polarization is applied in accordance with electromagnetic waves to be transmitted or received, the communication scheme therefor, etc.

In accordance with the communication function to be achieved by the electronic device 100A, one or plurality of antenna elements are mounted on the circuit board 114.

In FIGS. 1A and 2A, a structure is depicted in which a chip antenna for linear polarization is applied as the antenna element 112.

This chip antenna is an antenna that can be incorporated into the housing 110 even in a case where the housing 110 is small and thin.

As the conductive element 113, a conductive member structured of a metal material made of, for example, copper, or a conductive resin material, etc., is applied. The conductive element 113 is provided in an arbitrary area of the side surface of the housing 110 facing the antenna element 112.

Here, the conductive element 113 is provided so as to be electromagnetically coupled to the antenna element 112 and such that the polarizing direction of electromagnetic waves radiated from the antenna element 112 and the extending direction of the conductive element 113 match or substantially match each other. The conductive element 113 is insulated from the surroundings, and serves as a parasitic element not supplied with electric power from outside.

Specifically, the conductive element 113 is formed of a linear stick-shaped member, a thin plate, a thin film, a carbon mesh, etc., along the extending direction of the side surface of the housing 110, as depicted in FIGS. 1A and 1B.

The conductive element 113 is set such that its length (dimension) in the extending direction along the side surface of the housing 110 is $1/2^n$ (n=0, 1, 2, and 3: substantially, $\lambda$, $\lambda/2$, $\lambda/4$, and $\lambda/8$) of a wavelength $\lambda$ of an electromagnetic wave for transmission and reception by the antenna element 112.

In a case where a conductive stick-shaped member or a thin plate is used as the conductive element 113, for example, a structure in which the conductive element 113 is mounted in a side surface of the housing 110 in a manner to be partially exposed or a structure in which the conductive element 113 is laminated on the side surface can be applied, as depicted in FIG. 2A.

In a case where a conductive thin film or the like is used as the conductive element 113, for example, the side surface of the housing 110 can be directly coated with conductive-coating material, the conductive thin film can be laminated on the housing 110, or the conductive element 113 can be formed by metal deposition or sputtering.

That is, the conductive element 113 applied in the present embodiment is electromagnetically coupled to the antenna element 112 provided inside the housing 110 and has an arrangement, a shape, and dimensions that can achieve a resonance with a specific frequency of an electromagnetic wave transmitted or received by the antenna element 112. This conductive element 113 is structured to achieve a function as a so-called wave director which resonates with the specific frequency of an electromagnetic wave radiated from the antenna element 112 for propagation of the electromagnetic wave, and emits an electromagnetic wave equivalent to or stronger than the radiated electromagnetic wave to the outside of the housing 110.

Here, in the antenna device according to the present embodiment, as a structure for favorably resonating with respect to the electromagnetic wave of the specific frequency, one or an arbitrary combination of various components, such as a relation between the polarizing direction of an electromagnetic wave radiated from the antenna element 112 and the extending direction of the conductive element 113, the shape and dimensions of the conductive element 113, and a clearance between the antenna element 112 and the conductive element 113 may be applied. Also, another element (for example, a material forming the conductive element 113) may be applied.

A specific shape, dimensions, and layout of the conductive element 113 will be described in detail below in verification of simulation results.

In the electronic device 100A according to the present embodiment, the conductive element 113 is provided in a manner to be at least partially exposed to the side surface (outer surface) of the housing 110, as depicted in FIG. 1A, FIG. 1B, FIG. 1C and FIG. 2A. However, the present invention is not restricted thereto.

The conductive element 113 applied in the present invention may be mounted inside a wall-thickness portion of the side surface of the housing 110 by using insert molding or the like, as depicted in FIG. 2B.

Also, the conductive element 113 may be covered by a cover component formed of the same insulating material as that of the housing 110.

Moreover, the conductive element 113 may be provided on the inner surface side of the housing 110 facing the antenna element 112, as depicted in FIG. 2C.

As such, the structure in which the conductive element 113 not exposed to the outside of the housing 110 may be adopted as long as the conductive element 113 is provided to an area facing the antenna element 112.

Also, as another structure of the conductive element 113, a structure may be adopted in which a conductive resin material is applied and the conductive element 113 is integrally formed with the housing 110 formed of an insulating resin material on its side surface portion of an area facing the antenna element 112 by using two-color molding or the like.

In the electronic device 100A including the antenna device having the above-described structure, an electromagnetic wave radiated from the antenna element 112 provided inside the housing 110 is excited by the conductive element 113 provided to the antenna element 112 in a manner to have the predetermined arrangement (extending direction and clearance), shape, and dimensions, and radiated again, whereby the electronic wave can be radiated to the outside without being confined in the housing 110.

With this structure, electromagnetic-wave transmission and reception characteristics (antenna characteristics) can be improved with a simple and small-sized structure.

In the present embodiment, the electromagnetic-wave transmission and reception characteristics (antenna characteristics) can be improved by the conductive element 113 provided to the side surface of the housing 110, as described above. Therefore, a small-sized or thin antenna can be adopted as the antenna element 112 inside the housing 110.

As a result, it is possible to reduce influence of the antenna element incorporated in the housing 110 on the layout design of peripheral electronic components and the design of the housing.

Also, in the present embodiment, in a case where the structure is adopted in which the conductive element 113 is provided to be exposed to the side surface of the housing 110 and its nearby portion, the conductive element 113 is visually recognized by not only the user of the electronic device 100A but also many people.

In this case, by arbitrarily making a change in the material, shape, and the like of the conductive element 113 while ensuring at least the function for resonating with the electromagnetic wave of the specific frequency, the exposed conductive element 113 can be applied (incorporated) as part of the ornament and design of the housing 110, whereby the commercial value of the electronic device can be enhanced.

Next, an effect of the present embodiment (an improvement effect regarding electromagnetic-wave transmission and reception characteristics) is specifically described with reference to the results of simulation experiments.

First, a relation between the arrangement of the conductive element 113 with respect to the antenna element 112 in the antenna device according to the present embodiment and electromagnetic-wave transmission and reception characteristics is described.

Figure 3A:
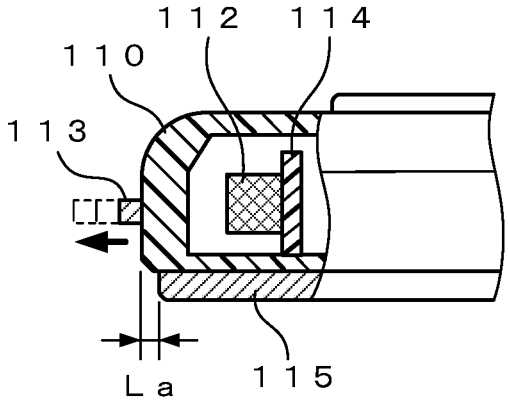
FIGS. 3A and 3B are enlarged sectional views of the main section of the electronic device according to the first embodiment.

FIGS. 3A and 38 are diagrams for describing parameters applied in a simulation experiment in the antenna device according to the present embodiment.

Here, FIG. 3A is a diagram for describing a clearance (a distance in a far-near direction) of the conductive element from the antenna element (an end of the rear lid) according to the present embodiment.

Figure 3B:
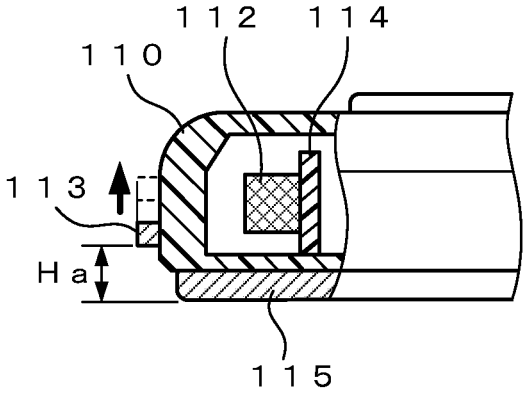

FIG. 3B is a diagram for describing a relative position (a position in an up-down direction) of the conductive element with respect to the antenna element (the end of the rear lid) according to the present embodiment.

Figure 4A:
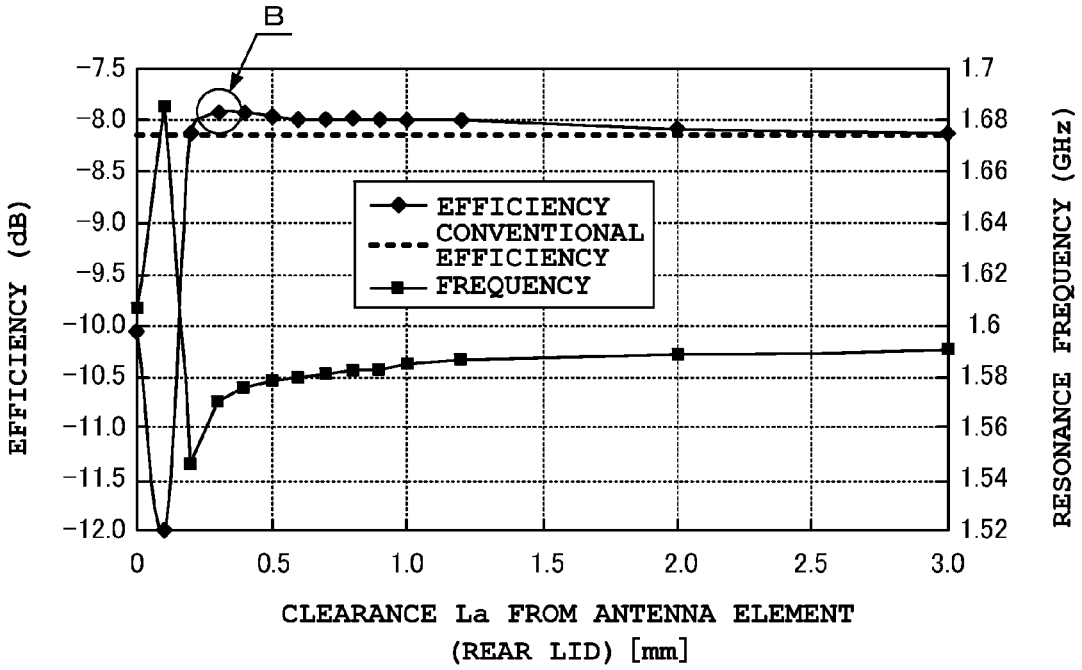
FIGS. 4A and 4B are diagrams depicting a first relation (simulation results) between the arrangement of a conductive element and electromagnetic-wave transmission and reception characteristics in the antenna device according to the first embodiment.
Figure 4B:
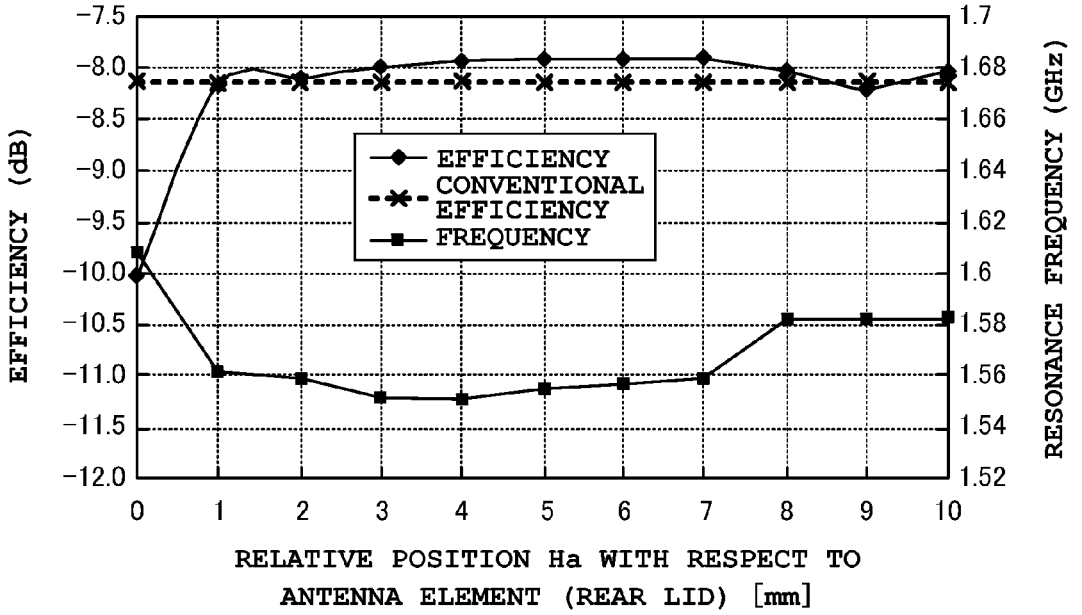
Figure 5:
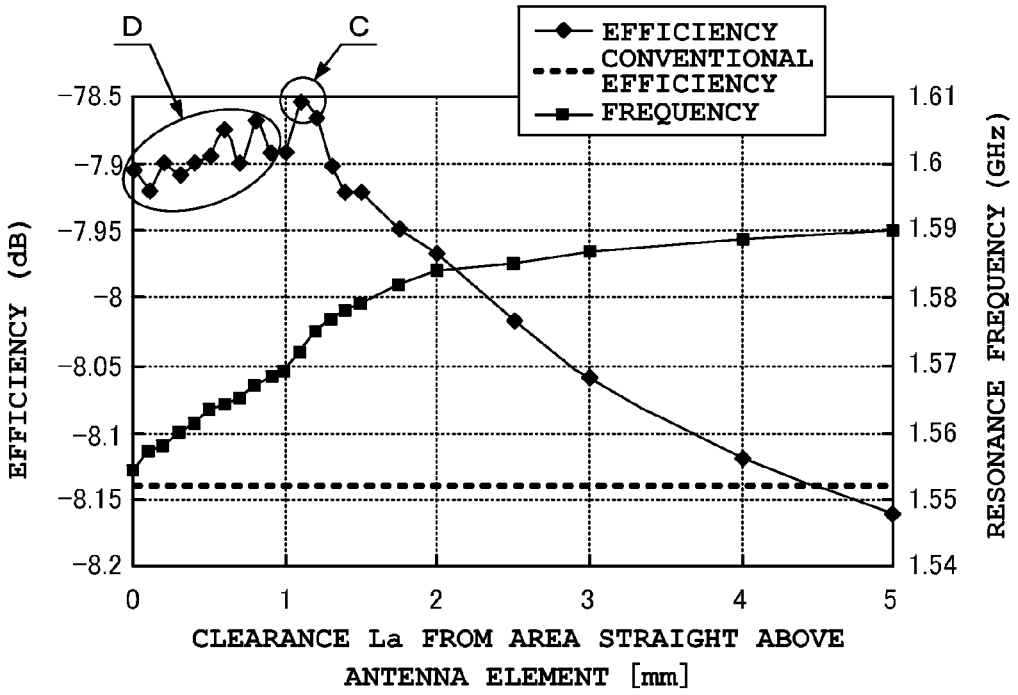
FIG. 5 is a diagram depicting a second relation (simulation results) between the arrangement of a conductive element and electromagnetic-wave transmission and reception characteristics in the antenna device according to the first embodiment.

FIGS. 4A, 4B and 5 are diagrams depicting a relation between the clearance of the conductive element in the antenna device according to the present embodiment and electromagnetic-wave transmission and reception characteristics (simulation results).

Here, FIG. 4A and FIG. 5 are diagrams depicting a relation between the clearance of the conductive element according to the present embodiment from the antenna element (the end of the rear lid) and electromagnetic-wave transmission and reception characteristics corresponding to electromagnetic-wave transmission and reception sensitivity, and a relation between the clearance and a resonance frequency.

FIG. 4B is a diagram depicting a relation between a relative position of the conductive element according to the present embodiment with respect to the antenna element (the end of the rear lid) and transmission and reception characteristics and a relation between the relative position and a resonance frequency.

In the present embodiment, a simulation experiment was performed on an electronic device (antenna device) with the following conditions.

Generally, in a portable electronic device, a structure in which a conductive component is arranged on the periphery of an antenna element or a structure including a metal-made rear lid in order to enhance waterproof performance is adopted. These conductive component and rear lid are known to significantly influence the characteristics of antenna devices.

Accordingly, in the present embodiment, in order to perform a simulation experiment under conditions similar to those for an actual product, each parameter was set for an electronic device having a structure where a metal-made rear lid has been provided on another surface side (the lower surface side in FIGS. 1B, 1C, 2A, 2B and 2C) of the electronic device 100A, as depicted in FIGS. 3A and 3B.

That is, as a distance (clearance) in the near-far direction of the conductive element 113 according to the present embodiment from the antenna element 112, a distance La in a horizontal direction (the right and left direction in the drawing) from an end of a metal-made rear lid 115 provided on another surface side of the housing 110 to the conductive element 113 was defined as depicted in FIG. 3A (hereinafter referred to as "clearance La" for convenience of description).

As a position (relative position) in an up-down direction of the conductive element 113 according to the present embodiment with respect to the antenna element 112, a distance Ha in a vertical direction (the up-down direction in the drawing) from the bottom surface of the metal-made rear lid 115 provided on the other surface side of the housing 110 to the conductive element 113 was defined as depicted in FIG. 3B (hereinafter referred to as "relative position Ha" for convenience of description).

Note that, in this simulation experiment, a copper-made member having a section with 1 mm per side (1 mm×1 mm) and a length of 31.1 mm in the extending direction was used as the conductive element 113.

The frequency of electromagnetic waves to be transmitted and received by the antenna element 112 was set at 1.57542 GHz that is a frequency applied to GPS.

In a simulation experiment for deriving electromagnetic-wave radiation efficiency and a resonance frequency while changing the clearance La of the conductive element 113 from the end of the rear lid 115 depicted in FIG. 3A with the relative position Ha of the conductive element 113 from the end of the rear lid 115 depicted in FIG. 3B being set at 0 mm (relative position Ha=0 mm; flush with the bottom surface of the rear lid 115), results such as those depicted in FIG. 4A were obtained.

That is, when the value of electromagnetic-wave radiation efficiency is large, electromagnetic-wave reception sensitivity or transmission efficiency is high, which means that the electromagnetic-wave transmission and reception characteristics are favorable.

Here, when the clearance La and the relative position Ha are changed, the frequency with the highest electromagnetic-wave radiation efficiency is changed. Thus, in FIG. 4A, for each clearance La, the value of radiation efficiency at the frequency with the highest radiation efficiency is referred to as "efficiency", and the frequency with the highest radiation efficiency (resonance frequency) is referred to as "frequency".

The same goes for FIGS. 4B, 5, 6A, 6B, 13, 15A and 15B, which will be described further below.

Also, in FIGS. 4A, 4B and 5, the value of electromagnetic-wave radiation efficiency in the case of a conventional structure without the conductive element 113 is referred to as "conventional efficiency" for comparison.

According to FIG. 4A, high radiation efficiency is obtained when the clearance La is set approximately equal to or longer than 0.2 mm. In particular, the radiation efficiency is at a maximum value when the clearance La is set at approximately 0.3 mm ("B" in the drawing), and tends to be higher than that of the conventional case without the conductive element 113 when the clearance La is approximately between 0.2 mm to 2 mm.

In addition, the resonance frequency tends to be stabilized when the clearance La is set approximately equal to or longer than 1.0 mm.

In the results depicted in FIG. 4A, the radiation efficiency tends to be high when the clearance La is short (that is, when the conductive element 113 is close to the rear lid 115). However, a phenomenon was observed in which the radiation efficiency is significantly degraded (unstabilized) when the clearance La is extremely short (approximately 0.1 mm) or the conductive element 113 is in contact with the rear lid 115 (the clearance La is 0 mm).

In addition, a phenomenon was observed in which the resonance frequency is unstabilized when the clearance La is short (when the clearance La is approximately equal to or shorter than 0.5 mm).

Next, results such as those depicted in FIG. 4B were obtained from a simulation experiment for deriving electromagnetic-wave radiation efficiency and a resonance frequency, in which the conductive element 113 was distant from the end of the rear lid 115 by 1.0 mm (the clearance La=1.0 mm) so as to obtain high radiation efficiency and a stable resonance frequency based on the results (FIG. 4A) of the simulation experiment, with the relative position Ha of the conductive element 113 from the end of the rear lid 115 being varied.

According to the results described above, high radiation efficiency is obtained when the relative position Ha is set approximately equal to or longer than 1 mm. In particular, the radiation efficiency is at a maximum value when the relative position Ha is set at approximately 5 mm, and tends to be higher than that of the case without the conductive element 113 when the relative position Ha is approximately between 1 mm to 8 mm.

Here, the state in which the relative position Ha has been set at approximately 5 mm corresponds to a state in which the conductive element 113 has been arranged straight above the antenna element 112 (the left facing position in FIGS. 3A and 3B).

Also, the resonance frequency tends to be stabilized when the relative position Ha is set approximately equal to or more than 1.0 mm.

Next, results such as those depicted in FIG. 5 were obtained from a simulation experiment for deriving electromagnetic-wave radiation efficiency and a resonance frequency, in which the conductive element 113 was distant from the end of the rear lid 115 by 5 mm (the relative position Ha=5 mm; an area right above the antenna element 112) so as to obtain high radiation efficiency and a stable resonance frequency based on the results (FIG. 4B) of the simulation experiment, with the clearance La of the conductive element 113 from the end of the rear lid 115 being varied.

According to this simulation experiment, the radiation efficiency has a maximum value when the clearance La is set at approximately 1.1 mm ("C" in the drawing), and tends to be higher than that in the case without the conductive element 113 when the clearance La is approximately equal to or shorter than 4 nm.

Also, the resonance frequency tends to be stabilized when the clearance La is set at approximately equal to or longer than 1.0 mm.

In the results depicted in FIG. 5, a phenomenon was observed in which the radiation efficiency tends to be low when the clearance La is long (that is, when the conductive element 113 is far from the end of the rear lid 115) but, when the clearance La is approximately equal to or shorter than 1 mm, periodic changes ("D" in the drawing) are found in the radiation efficiency, resulting in instability.

Next, a relation between the length (dimension) of the antenna element 112 and electromagnetic-wave radiation efficiency in the antenna device according to the present embodiment is described.

Figure 6A:
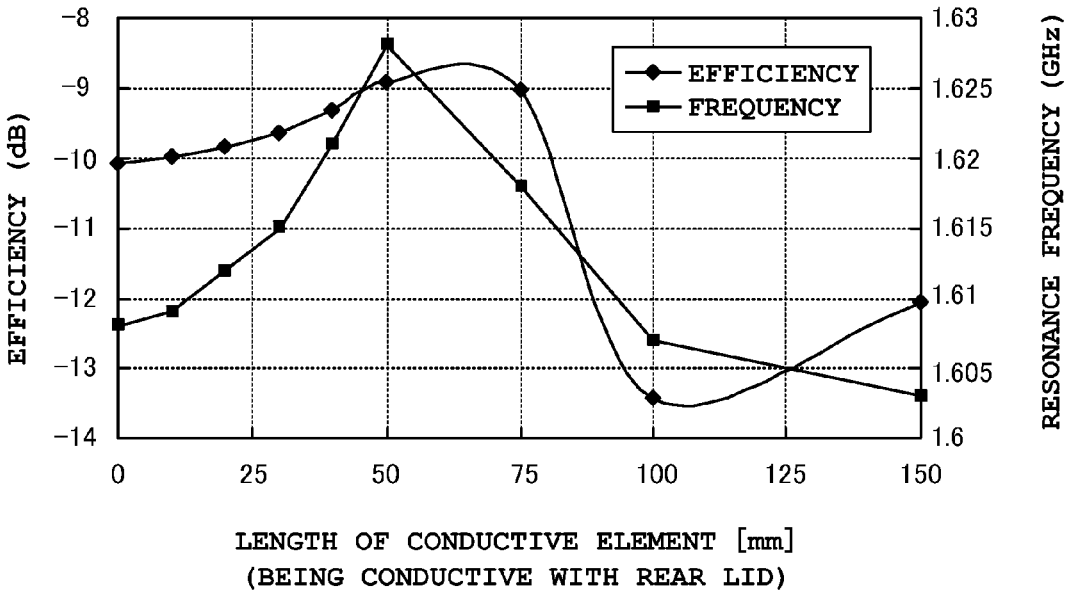
FIGS. 6A and 6B are diagrams depicting a relation (simulation results) between the length of a conductive element and electromagnetic-wave transmission and reception characteristics in the antenna device according to the first embodiment.
Figure 6B:
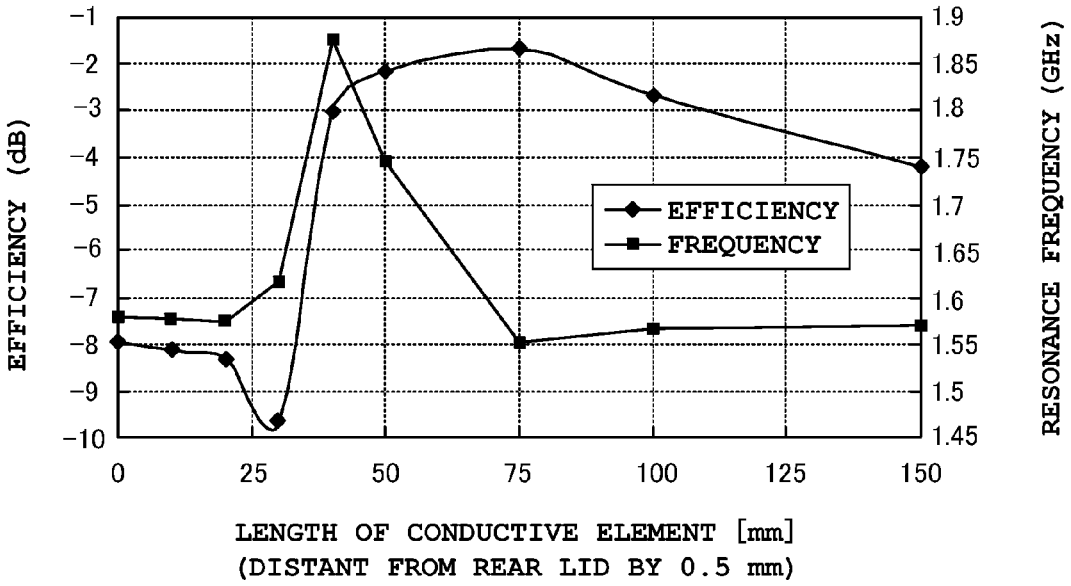

FIGS. 6A and 6B are diagrams depicting a relation (simulation results) between the length of the conductive element and electromagnetic-wave radiation efficiency in the antenna device according to the present embodiment.

Here, FIG. 6A is a diagram depicting a relation between the length of the conductive element and radiation efficiency and a relation between the length and a resonance frequency, with the conductive element according to the present embodiment being in contact with the rear lid (in a conductive state). Here, the length of the conductive element is a relative length with respect to a reference value (an initial value). The reference value is 31.1 mm, and the length of the conductive element has the reference value of 31.1 mm when the length of the horizontal axis in FIG. 6A indicates 0. The same goes for FIG. 6B.

FIG. 6B is a diagram depicting a relation between the length of the conductive element and radiation efficiency and a relation between the length and a resonance frequency, with the conductive element according to the present embodiment being distant from the rear lid (in a non-conductive state).

In a simulation experiment for deriving electromagnetic-wave radiation efficiency and a resonance frequency with reference to the conductive element 113 having a shape and a length in the extending direction equivalent to those in the above-described simulation experiment while changing the length with the relative position Ha depicted in FIG. 3B being set at 0 mm and the clearance La depicted in FIG. 3A being set at 0 mm (the conductive element 113 is in contact with the rear lid 115), results such as those depicted in FIG. 6A were obtained.

According to this simulation experiment, a phenomenon was observed in which the radiation efficiency is degraded when the length of the conductive element 113 is set approximately equal to or longer than 75 mm.

Also, a phenomenon was observed in which the resonance frequency is relatively significantly changed when the length of the conductive element 113 is long (approximately equal to or longer than 50 mm).

By contrast, results such as those depicted in FIG. 6B were obtained from a simulation experiment for deriving electromagnetic-wave radiation efficiency and a resonance frequency while changing the length of the conductive element 113 in the extending direction, with the clearance La depicted in FIG. 3A being set at 0.5 mm (that is, the conductive element 113 is distant from the end of the rear lid 115 by 0.5 mm).

According to this simulation experiment, high radiation efficiency is obtained even when the length of the conductive element 113 is set long at approximately equal to or longer than 75 mm. In particular, the radiation efficiency has a maximum value with the length of conductive element 113 being set at approximately 75 mm.

Also, the resonance frequency tends to be stabilized when the length of the conductive element 113 is long (approximately equal to or longer than 75 mm).

Here, since the reference value (initial value) of the length of the conductive element 113 in the extending direction depicted in FIGS. 6A and 6B is set at 31.1 mm, the full length of the conductive element 113 is approximately 106 mm (=31.1+75).

On the other hand, since the electromagnetic-wave frequency to be applied to GPS is 1.57542 GHz, the full length of 106 mm of the conductive element 113 corresponds to approximately 1/2 of the wavelength $\lambda$ ($=\lambda/2$) of the electromagnetic wave in this case.

Although not depicted in the drawings, the inventors have confirmed from similar simulation experiments that, by setting the full length of the conductive element 113 so as to correspond to a length of $1/2^n$ (n=0, 1, 2, 3, . . .) of the wavelength $\lambda$ of the electromagnetic wave used in deriving radiation efficiency, high radiation efficiency and a stable resonance frequency tend to be generally obtained near the length.

Thus, by appropriately setting the arrangement of a conductive element with respect to an antenna element and the shape and dimension (length) of the conductive element based on the results of each of the simulation experiments described above, it is possible to achieve an antenna device capable of resonating with a specific frequency of an electromagnetic wave to be transmitted or received by an antenna element so as to favorably resonate with the electromagnetic wave of the specific frequency.

Next, radiation characteristics of the antenna device according to the present embodiment are described by using a conductive element whose arrangement, shape, and dimensions have been set to achieve high radiation efficiency and a stable resonance frequency based on the results of the simulation experiments described above.

Here, comparison and verification are made by using a structure in which the conductive element according to the present embodiment is not included in an antenna device (hereinafter referred to as a "comparative example").

Figure 7A:
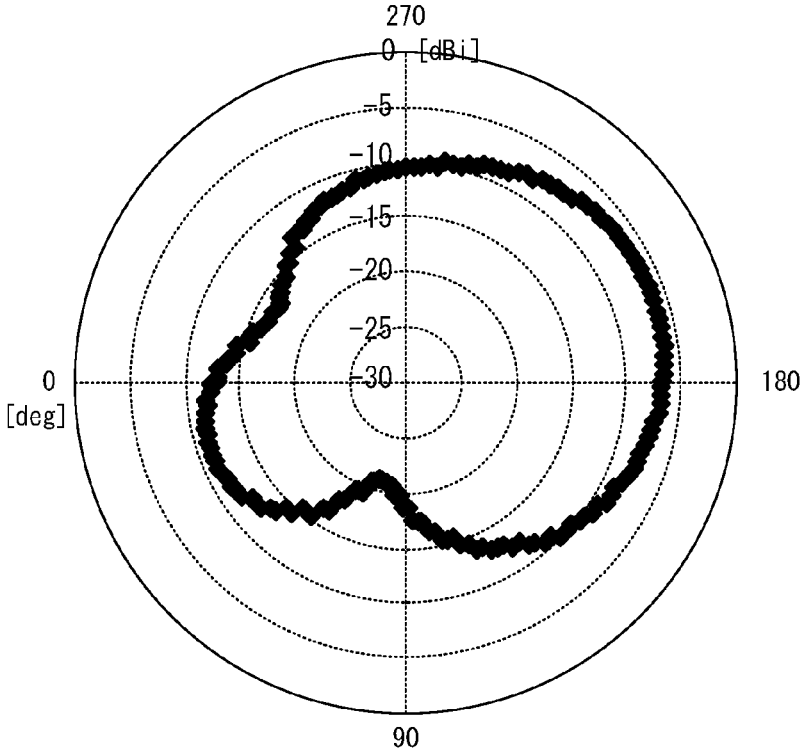
Figure 7B:
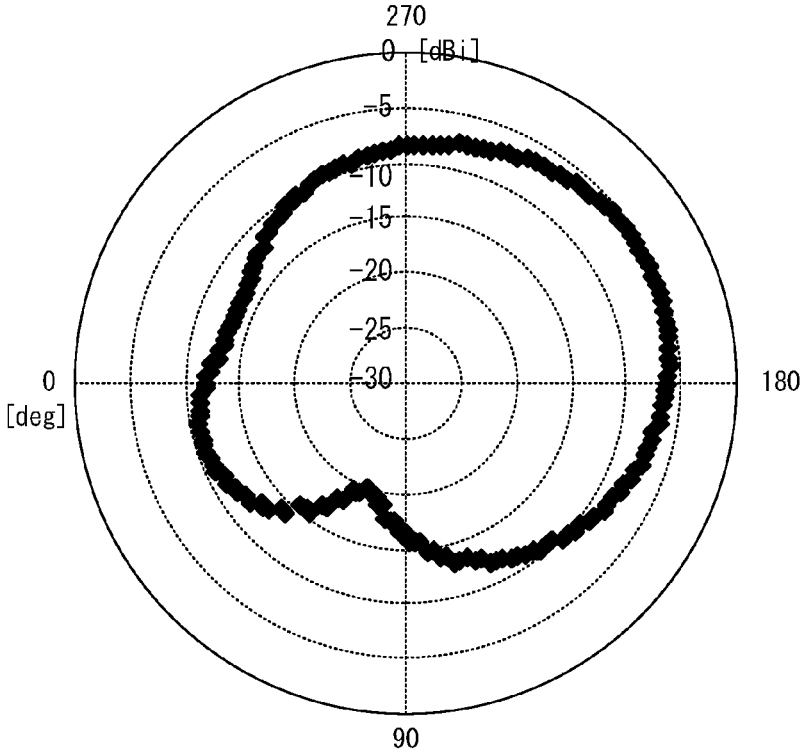

FIGS. 7A and 7B are diagrams depicting radiation characteristics in the antenna device according to the present embodiment (simulation results).

FIG. 7A is a diagram depicting radiation characteristics in an antenna device serving as a comparative example of the present embodiment.

FIG. 7B is a diagram depicting radiation characteristics in the antenna device according to the present embodiment.

First, a structure in which the conductive element 113 is not provided to the side surface of the housing 110 in the above-described electronic device 100A is taken as comparative example, and electromagnetic-wave radiation characteristics in this comparative example is described.

In the comparative example, as a result of a simulation experiment for deriving radiation characteristics at the time of the transmission or reception of an electromagnetic wave having a frequency of 1.57542 GHz (approximately 1.6 GHz) that is a frequency applied to GPS by using a linear-polarization-type antenna element, a radiation pattern such as that depicted in FIG. 7A was obtained.

Here, the comparative example is described with reference to the electronic device 100A depicted in FIG. 1A. FIG. 7A depicts a radiation pattern in all circumferential directions (0° to 360°) on a plane including one surface (or another surface) of the housing 110 provided with the display section 111.

An average gain in the comparative example obtained from the simulation experiment was −6.35 dBi.

By contrast, a radiation pattern such as that depicted in FIG. 7B was obtained as a result of a simulation experiment for deriving radiation characteristics under the same conditions as those in the above-described comparative example being performed in the present embodiment where the arrangement, shape, and dimensions of the conductive element 113 on the side surface facing the antenna element 112 provided inside the housing 110 have been appropriately set to achieve high radiation efficiency and a stable resonance frequency based on the result of the simulation experiment described above.

An average gain in the present embodiment obtained from the simulation experiment was −5.9 dBi.

From above, it was found that the gain is improved (by approximately 0.45 dBi) by the structure of the present embodiment, as compared to the structure not provided with the conductive element 113 (comparative example).

The improvement effect regarding radiation characteristics in the present embodiment is verified.

In general, in a small-sized electronic device such as a wristwatch-type terminal, the housing is small or thin and has a sealed structure. Therefore, an antenna device incorporated therein cannot obtain sufficient radiation resistance. In addition, the size of a necessary ground plate has to be relatively small.

For this reason, radiation efficiency in the antenna device is poor, and most of the electric power fed thereinto is consumed as heat. Most of this consumption energy generates nearby electromagnetic waves around the housing of the electronic device, and causes a large amount of unintended leak currents to stay at the housing.

As a result, electromagnetic waves that are directly involved in intended electromagnetic-wave transmission and reception are affected, whereby their radiation characteristics are degraded and the communication status of the electronic device becomes unstable.

By contrast, in the present embodiment, the structure is applied in which the conductive element 113 is arranged on the side surface facing the antenna element 112 provided inside the housing 110.

As a result, it is possible to efficiently receive, by the conductive element 113, energy which causes the above-described nearby electromagnetic waves and leak currents, resonate with electromagnetic waves with a specific frequency radiated from the antenna element 112, and efficiently radiate the electromagnetic waves again in a direction toward the outside of the housing 110.

Therefore, according to the present embodiment, an antenna device whose radiation characteristics have been improved by improving an average gain can be achieved, as depicted in FIGS. 3A and 3B.

<Modification Example of First Embodiment>

Next, a modification example of the first embodiment is described.

Figure 8A:
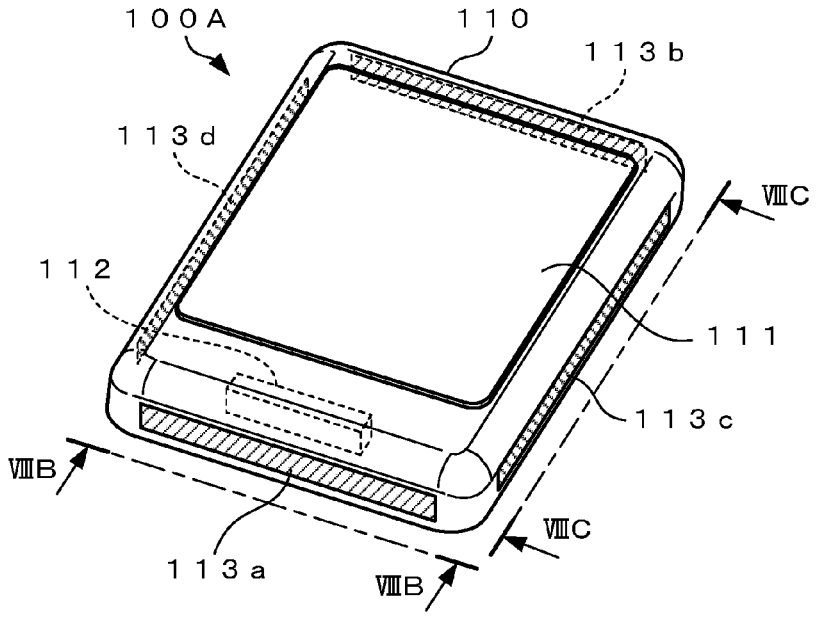
FIGS. 8A, 8B and 8C are schematic structural diagrams depicting a modification example of the electronic device in which the antenna device according to the first embodiment has been applied.
Figure 8B:
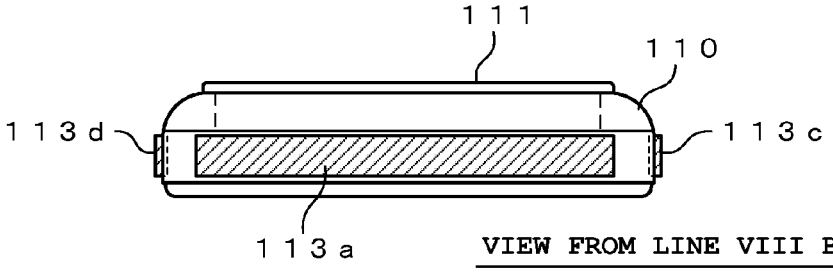
Figure 8C:
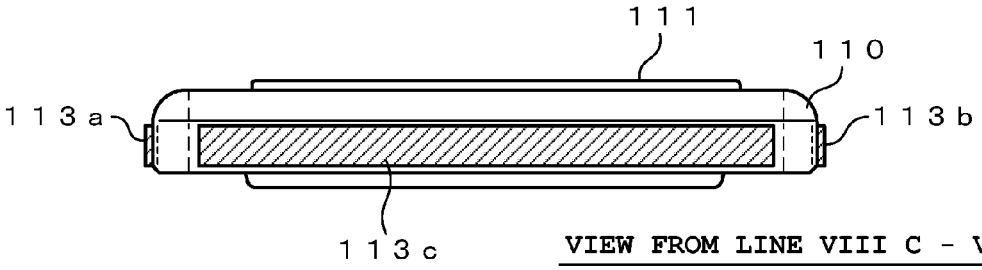

FIGS. 8A, 8B and 8C are schematic structure diagrams depicting a modification example of the electronic device in which the antenna device according to the first embodiment has been applied.

Here, FIG. 8A is a perspective view depicting the outer appearance structure of the electronic device according to the present embodiment.

FIG. 8B is a diagram depicting a side surface of the electronic device when viewed from line VIIIB-VIIIB (for convenience of description, "VIII" is used herein as a sign corresponding to a Roman numeral of "8" depicted in FIGS. 8A, 8B, and 8C, and the same will apply hereinafter) in FIG. 8A.

FIG. 8C is a diagram depicting a side surface of the electronic device when viewed from line IIIC-VIIIC in FIG. 8A.

Figure 9A:
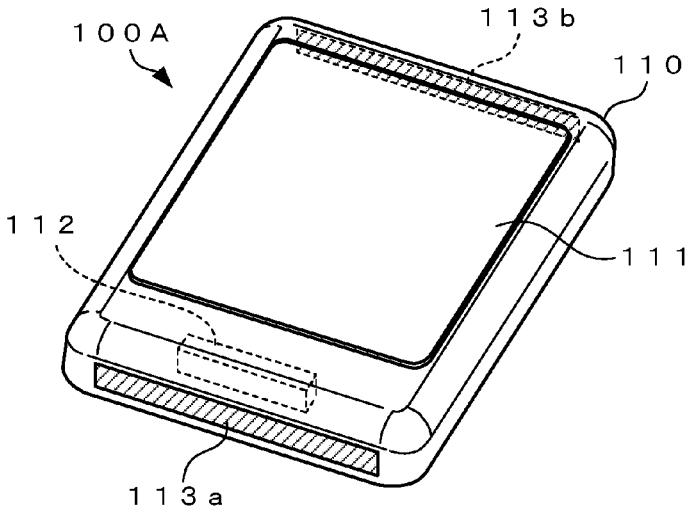
FIGS. 9A, 9B and 9C are schematic structural diagrams depicting another modification example of the electronic device to which the antenna device according to the first embodiment has been applied.
Figure 9B:
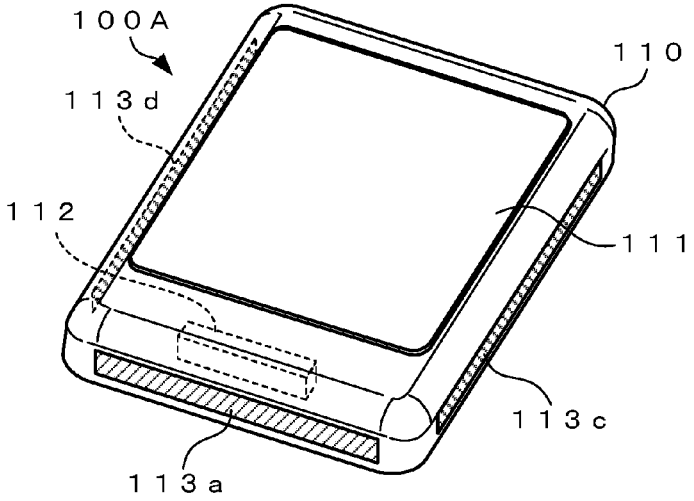
Figure 9C:
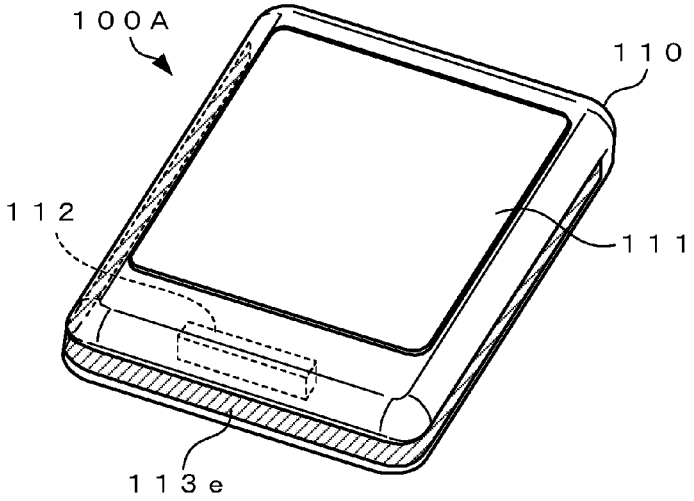

FIGS. 9A, 9B and 9C are schematic structure diagrams depicting another modification example of the electronic device in which the antenna device according to the first embodiment has been applied.

Note that a conductive element in FIGS. 8A to 8C and 9A to 9C has also been hatched so as to clarify the graphical representation for convenience of reference.

Also note that sections equivalent to those in the above-described embodiment are provided with the same reference numerals for simplification of description.

In the above-described first embodiment, the conductive element 113 is provided to only one side of the housing 110 facing the antenna element 112 provided inside the housing 110.

By contrast, in the modification example of the present embodiment, conductive elements 113*a* to 113*d* are provided to the respective four side surfaces of the housing 110 including the side surface facing the antenna element 112 (the side surface on the frontward side in FIG. 8A), as depicted in FIGS. 8A to 8C.

According to the electronic device 100A including the above-structured antenna device, electromagnetic-wave radiation characteristics (antenna characteristics) can be improved, as with the embodiment described above.

In particular, since the conductive element 113 is provided to each of the four side surfaces of the housing 110, an electromagnetic wave radiated from the antenna element 112 and confined inside the housing 110 can be received by the conductive elements 113 arranged in four directions for excitation and radiated again to the outside of the housing 110, whereby the electromagnetic-wave radiation characteristics can be more improved.

In the present embodiment, since the conductive element 113 is provided to be exposed to each side surface of the housing 110, any material, shape, etc., of the conductive elements 113 can be set to provide a sense of uniformity as an ornament or design of the housing 110. This can also contribute to the creation of more varieties of design.

Note that, although the structure has been depicted in FIGS. 8A, 8B and 8C in which the conductive elements are provided to all of the respective four side surfaces of the housing, the present invention is not limited thereto.

For example, a structure may be adopted in which the conductive elements 113*a* and 113*b* are provided to two side surfaces of the housing 110 facing each other (in the drawing, the side surface adjacent to the antenna element 112 and the side surface facing that side surface), as depicted in FIG. 9A.

Also, a structure may be adopted in which the conductive elements 113*a*, 113*c*, and 113*d* are provided to three side surfaces of the housing (in the drawing, the side surface adjacent to the antenna element 112 and the side surfaces adjacent thereto), as depicted in FIG. 9B.

Moreover, a structure may be adopted in which a conductive element 113*e* continuously and integrally formed to arbitrary side surfaces adjacent to each other is provided (in the drawing, three side surfaces in total, that is, the side surface adjacent to the antenna element 112 and the side surfaces adjacent thereto), as depicted in FIG. 9C.

<Second Embodiment>

Next, a second embodiment of the electronic device in which the antenna device according to the present invention has been applied is described.

Figure 10A:
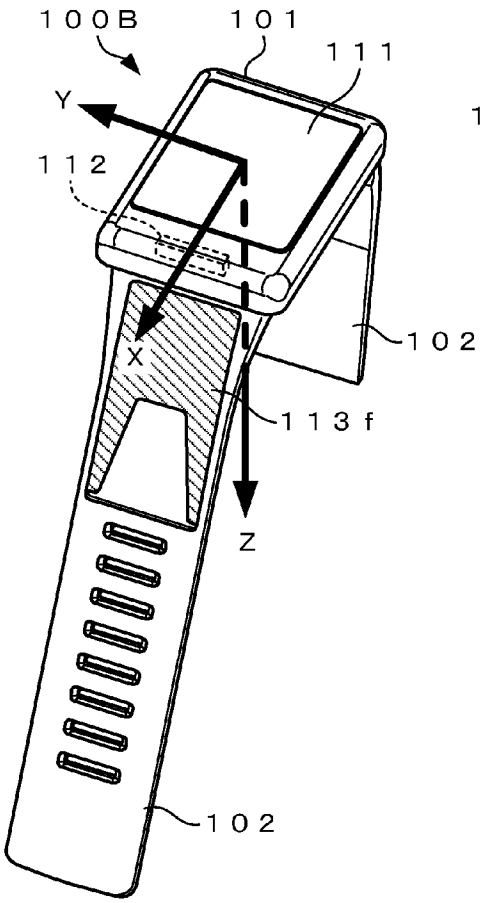
FIGS. 10A, 10B and 10C are schematic structural diagrams depicting an electronic device according to a second embodiment.
Figure 10B:
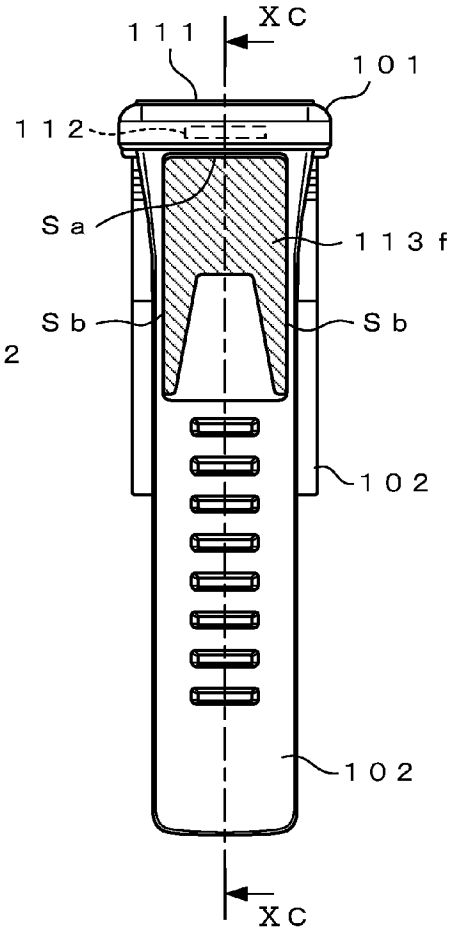
Figure 10C:
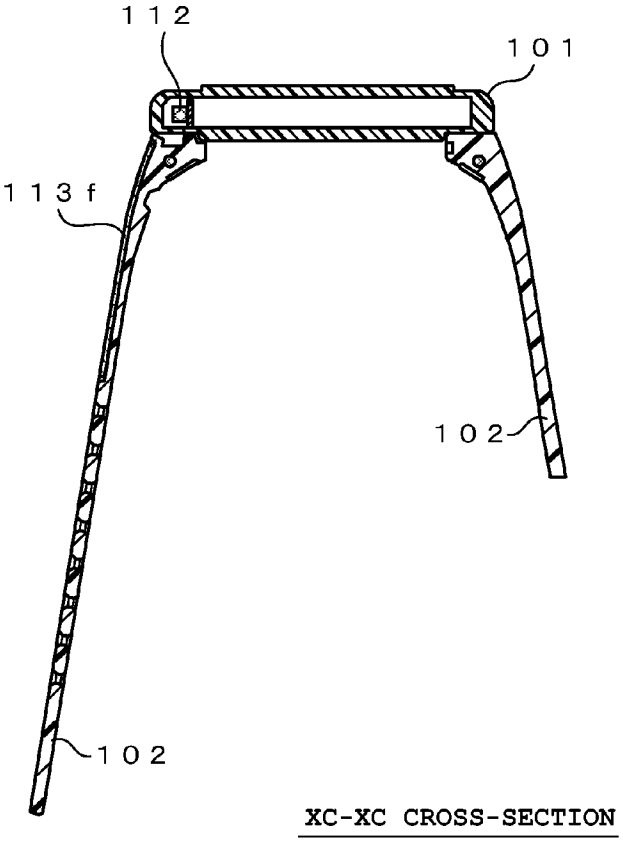

FIGS. 10A, 10B and 10C are schematic structure diagrams depicting the electronic device according to the second embodiment.

Here, FIG. 10A is a perspective view of the outer appearance structure of the electronic device according to the present embodiment.

FIG. 10B is a diagram depicting a side surface of the electronic device depicted in FIG. 10A when viewed from a belt section side.

FIG. 100 is a schematic view of a sectional structure of the electronic device taken along line XC-XC in FIG. 10B (for convenience of description, "X" is used herein as a sign corresponding to a Roman numeral of "10" depicted in FIGS. 10A to 10C).

Note that a conductive element in FIGS. 10A and 10B has been hatched so as to clarify the graphical representation for convenience of reference.

Also note that sections equivalent to those in the above-described first embodiment are provided with the same reference numerals for simplification of description.

FIGS. 11A to 11E are schematic structural diagrams depicting conductive elements applied in the present embodiment.

Figure 11A:
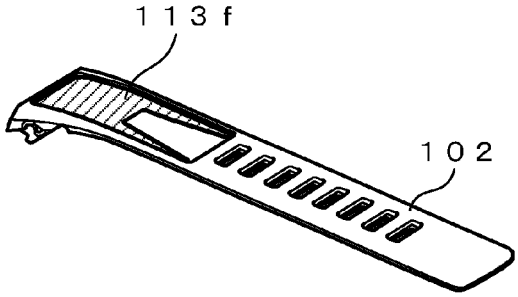
FIGS. 11A to 11E are schematic structural diagrams depicting conductive elements applied in the second embodiment.
Figure 11B:
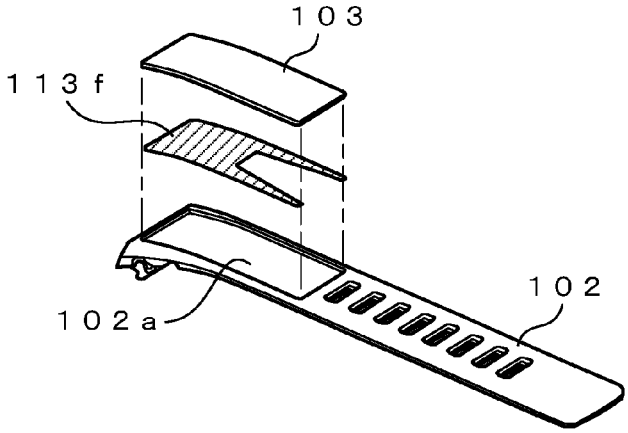

Here, FIGS. 11A and 11B are schematic diagrams depicting the mounting of a conductive element to a belt section.

Figure 11C:
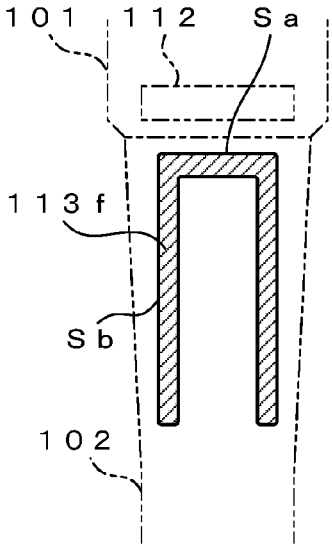
Figure 11D:
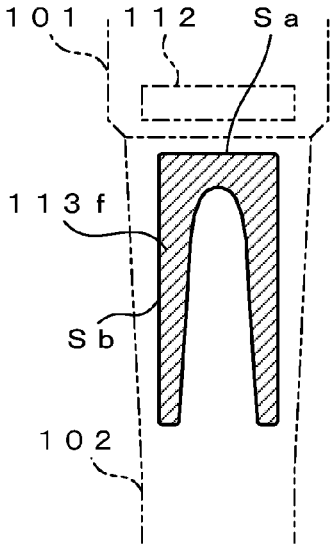
Figure 11E:
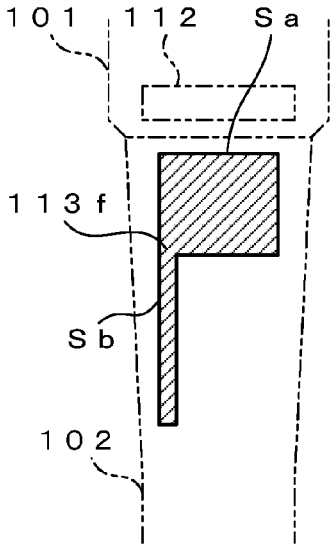

FIGS. 11C to 11E are schematic diagrams depicting other examples of a plane shape of the conductive element.

In the structure of the above-described first embodiment, in the electronic device 100A constituted by the single housing 110, the conductive element 113 is provided to one or plurality of side surfaces of the housing 110.

In the structure of the second embodiment, in a wristwatch-type electronic device where a belt section for mounting the housing of the electronic device on a human body has been additionally provided in the housing, a conductive element has been provided to the belt section.

Specifically, an electronic device 100B according to the second embodiment has a wristwatch-type structure including the housing 101 having a structure equivalent to that of the electronic device 100A depicted in the above-described first embodiment and a belt section (mount member) 102 for mounting the housing 101 on a human body, such as a wrist.

Inside the housing 101, the antenna element 112 has been provided, as with the above-described electronic device 100A.

Here, in the housing 101 according to the present embodiment, a conductive element that functions as a wave director is not provided on the side surface of the housing 101 facing the antenna element 112.

The belt section 102 is constituted by a band-shaped member made of an insulating material such as urethane resin, and mounted near a pair of side surfaces of the housing 101 facing each other, on another surface side (the lower surface side in the drawing) of the housing 101.

In an area of the belt section 102 facing the antenna element 112 provided inside the housing 101, a conductive element 113*f* having a predetermined plane shape is provided, which is electromagnetically coupled to the antenna element 112.

Here, the conductive element 113*f* is formed of, for example, a conductive thin plate or thin film. This conductive element 113*f* is insulated from the surroundings, and serves as a parasitic element not supplied with electric power from outside.

With the conductive element 113*f* being accommodated in a recessed accommodating section 102*a* provided to the belt section 102, the accommodating section 102*a* is closed by, for example, a cover member 103 made of a material equivalent to that of the belt section 102, whereby the conductive element 113*f* is incorporated inside the belt section 102.

The conductive element 113*f* has a plane shape provided with, for example, a pair of projections which includes a wide-width section whose base portion is on the housing 101 side and has been formed to be tapered toward the tip direction of the belt section 102, as depicted in FIGS. 10A and 10B.

In this conductive element 113*f*, the wide-width section extends such that it faces the extending direction (or a side surface of the housing 101) of the antenna element 112 provided inside the housing 101 with a predetermined clearance. This wide-width section has a side (first side) Sa on a reception side for receiving an electromagnetic wave radiated from the antenna element 112.

Each projection has a side (second side) Sb on a radiation side which projects along the extending direction of the belt section 102 and resonates with an electromagnetic wave of a specific frequency received by the side Sa on the reception side for reradiation.

In the present embodiment, the side Sa on the reception side and the sides Sb on the radiation side of the conductive element 113*f* are substantially perpendicular to each other.

Here, in the present embodiment, the length of the side Sa on the reception side of the conductive element 113*f* is set at, for example, 1/8 of the wavelength λ (=λ/8) of an electromagnetic wave to be transmitted or received by the antenna element 112, and the length of each side Sb on the radiation side is set at, for example, 1/4 of the wavelength) λ (=λ/4).

As a result, as with the above-described first embodiment, the conductive element 113*f* functions as a wave director which is electromagnetically coupled to the antenna element 112, efficiently receives an electromagnetic wave radiated from the antenna element 112 and its periphery, converts the electromagnetic wave to current, and radiates an electromagnetic wave with the resonated frequency into space again.

The above-structured conductive element 113*f* is formed by patterning a conductive thin plate or thin film into a predetermined plane shape.

Here, as with the above-described first embodiment, the conductive element 113*f* can be formed by applying a method of coating with a conductive-coating material, metal deposition, sputtering, or the like.

Note that the shape of the conductive element 113*f* is not limited to the shape depicted in FIG. 10A, 10B, 11A or 11B. As described above, the conductive element 113*f* may have another plane shape and other dimensions as long as the conductive element 113*f* can receive an electromagnetic wave radiated from the antenna element 112 for excitement and radiate it again to the outside.

Specifically, the conductive element 113*f* may have, for example, a flat substantially inverted-C shape with a substantially uniform width, as depicted in FIG. 11C. Alternatively, the conductive element depicted in FIGS. 10A and 10B may have, for example, a flat substantially-U shape with a notch formed up to a portion near the base, as depicted in FIG. 11D. Still alternatively, the conductive element depicted in FIGS. 10A and 10B may have, for example, a plane shape with a single projection formed from the wide-width portion of the base and having a substantially uniform width, as depicted in FIG. 11E. As the shape of the conductive element 113*f*, the shapes depicted in FIGS. 11D and 11E can be favorably applied.

Also, the structure for providing the conductive element 113*f* to the belt section 102 is not limited to the incorporating method depicted in FIGS. 11A and 11B, and another structure may be applied as long as the function as a wave director can be achieved.

Specifically, as described in the first embodiment, the conductive element 113*f* may be formed of a conductive-coating material by applying the method of coating the front surface of the belt section 102 made of an insulating material with the conductive-coating material. Alternatively, the conductive element 113*f* may be formed by applying a method of laminating a conductive thin film, metal deposition, sputtering, or the like. Still alternatively, the conductive element 113*f* may be formed by using insert molding or the like to mount a conductive member in the belt section 102. Still alternatively, the conductive element 113*f* may be formed of conductive resin by using two-color molding or the like to integrally form the conductive resin on the belt section 102.

The structure of the conductive element 113*f* is not limited to the structure depicted in FIGS. 10A, 10B and 10C in which the conductive element 113*f* is provided to only one of paired belt sections 102 additionally provided to the housing 101 (the belt section near the antenna element 112), and the conductive element 113*f* may be provided to each of the paired belt sections 102.

Here, by appropriately setting the shape, dimensions, and the like of the conductive element 113*f* provided to each belt section 102, the electromagnetic radiation characteristics can be further improved.

According to the above-structured electronic device 100B including the antenna device, the conductive element 113*f* can be arranged on the belt section 102 such that it faces the antenna element 112 incorporated in the housing 101, as with the above-described first embodiment. Accordingly, an antenna device whose radiation characteristics have been improved by improving an average gain can be achieved.

In particular, since the conductive element 113*f* can be provided to the belt section 102 additionally provided to the housing 101, design flexibility in the shape of the conductive element 113*f* can be enhanced and, by appropriately designing a transmission line, an antenna device for circular polarization and an antenna device capable of directivity control can be achieved.

In this case, the conductive element 113*f* can be incorporated in part of ornament or design of the electronic device 100B, and the commercial value can also be further increased.

Also, by the conductive element 113*f* being provided to the belt section 102, the design of the housing 101 is not required to be changed. As a result, the radiation characteristics can be improved only by application to an ancillary component such as the belt section 102, without affecting the housing manufacturing method or cost.

Next, an effect of the present embodiment (an improvement effect regarding electromagnetic-wave radiation characteristics) is specifically described with reference to the results of simulation experiments.

First, a relation between the shape of the conductive element 113 and its tilt angle when arranged with respect to the antenna element 112 in the antenna device according to the present embodiment and electromagnetic-wave radiation efficiency is described.

FIGS. 12A to 12F are diagrams for describing parameters applied in a simulation experiment in the antenna device according to the present embodiment.

Figure 12A:
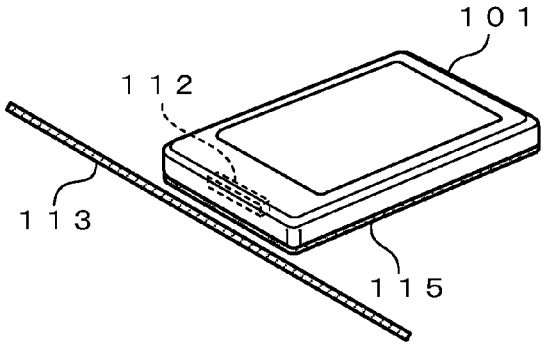
FIGS. 12A to 12F are diagrams for describing parameters applied in simulation experiments in an antenna device according to the second embodiment.
Figure 12D:
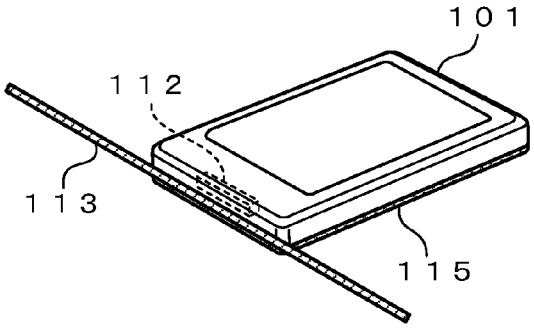

Here, FIGS. 12A and 12D are schematic perspective diagrams depicting a state in which a conductive element according to the present embodiment has a linear shape and has been arranged along the extending direction of a side surface of the housing.

Figure 12B:
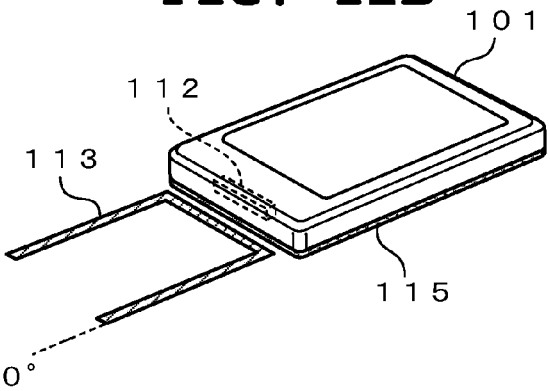
Figure 12E:
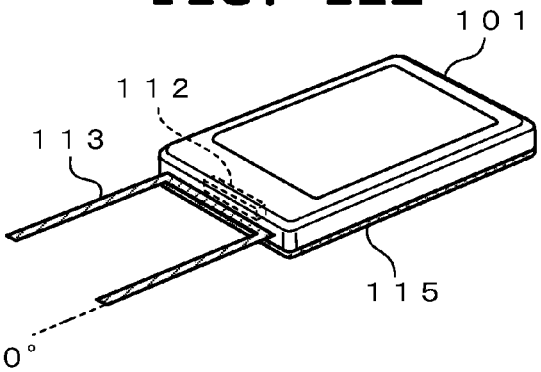

FIGS. 12B and 12E are schematic perspective diagrams depicting a state in which the conductive element has a bent shape and has been arranged at a tilt angle of 0°.

Figure 12C:
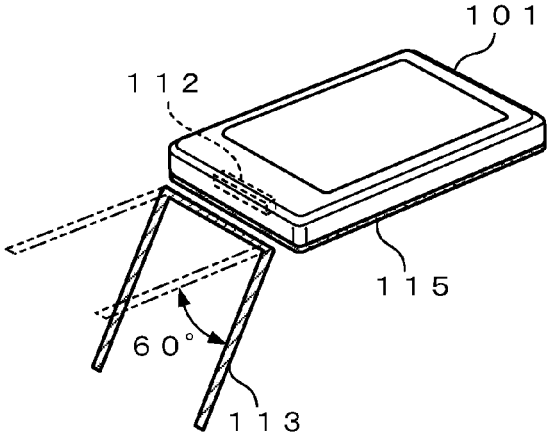
Figure 12F:
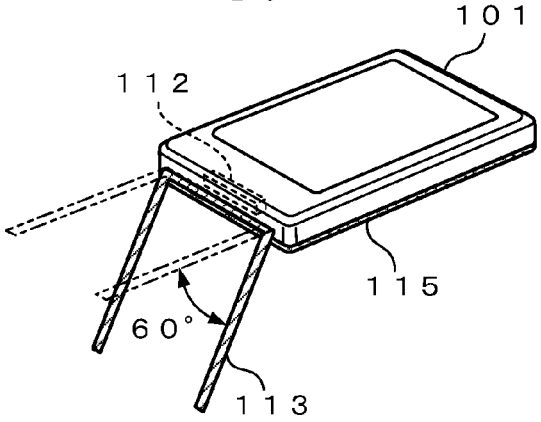

FIGS. 12C and 12F are schematic perspective diagrams depicting a state in which the conductive element has a bent shape and has been arranged at a tilt angle of 60°.

Figure 13:
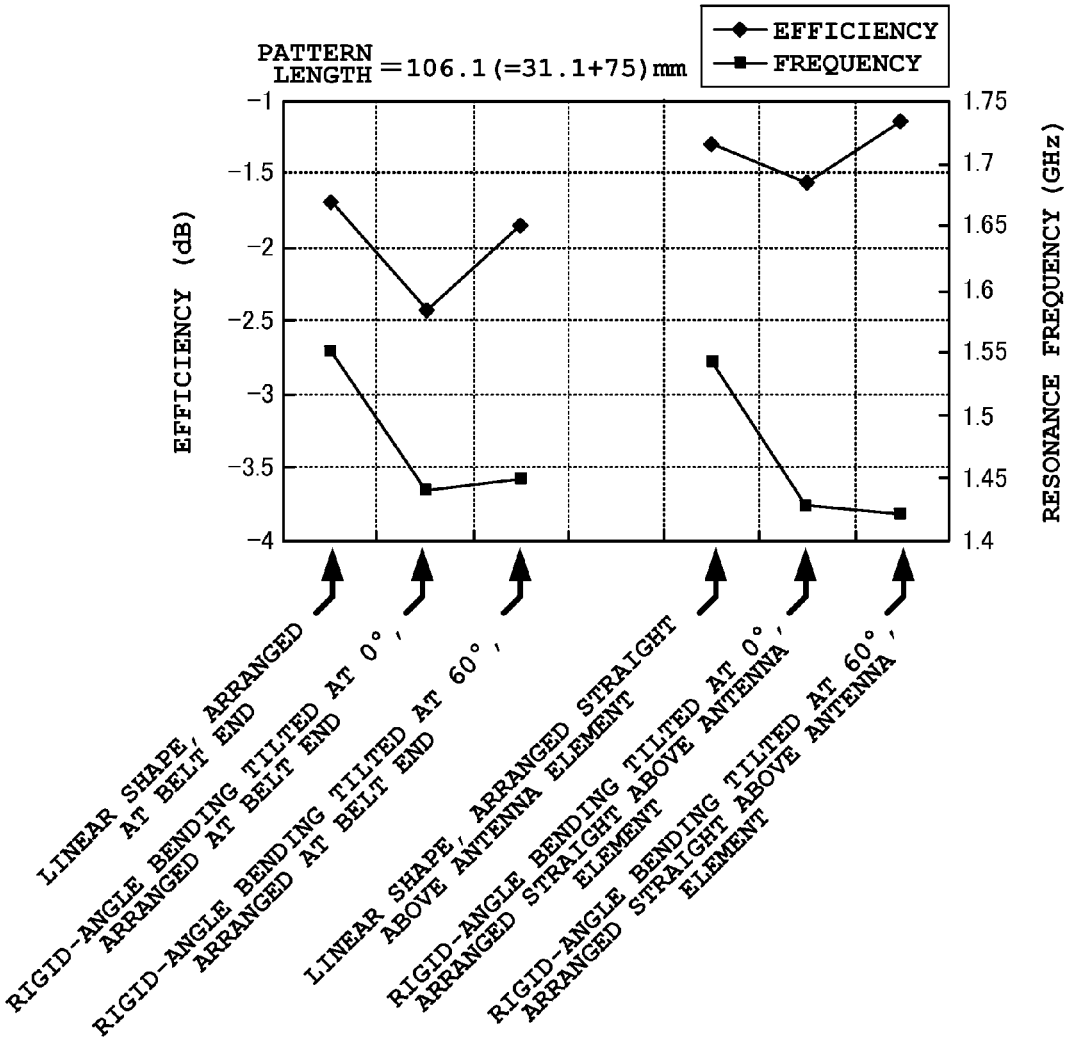
FIG. 13 is a diagram depicting a relation (simulation results) between the shape of the conductive element and its tilt angle when arranged and electromagnetic-wave radiation efficiency in the antenna device according to the second embodiment.

FIG. 13 is a diagram depicting a relation (simulation results) between the shape of the conductive element and its tilt angle when arranged in the antenna device according to the present embodiment and electromagnetic-wave radiation efficiency.

In the present embodiment, simulation experiments were performed on electronic devices (antenna devices) structured as depicted in FIGS. 12A to 12F.

That is, the antenna devices depicted in FIGS. 12A and 12D each include the conductive element 113 constituted by a linear-shaped conductive member whose arrangement with respect to the antenna element 112, shape, and dimension (length) have been appropriately set based on the results of the simulation experiments verified in the above-described first embodiment.

The antenna devices depicted in FIGS. 12B and 12E each include the conductive element 113 acquired by the linear-shaped conductive member depicted in FIGS. 12A and 12D being bent at a predetermined point at the right angle to form an inverted-C shape and arranged at a tilt angle of 0°.

The antenna devices depicted in FIGS. 12C and 12F each include the conductive element 113 acquired by the inverted-C-shaped conductive member depicted in FIGS. 12B and 12E being arranged at a tilt angle of 60°.

In these simulation experiments, a copper-made member having a section with 1 mm per side (1 mm×1 mm) and a length of 106.1 mm (=31.1+75) in the extending direction was used as the conductive element 113. The frequency of electromagnetic waves to be transmitted or received by the antenna element 112 was set at 1.57542 GHz that is a frequency applied to GPS.

The conductive element 113 was arranged in an area of an end of the belt section 102 additionally provided to the housing 101 on the housing 101 side in a manner to face the antenna element 112 (flush with the rear lid 115 with the relative position Ha of approximately 0 mm), as with the structures depicted in FIGS. 10A, 10B and 10C.

From simulation experiments for deriving electromagnetic-wave radiation efficiency and a resonance frequency when the conductive element 113 has a linear shape and when the conductive element 113 is bent at the right angle to form an inverted-C shape and the tilt angle is set at 0° and 60° as depicted in FIGS. 12A to 12C, results such as those on the left side of the graph depicted in FIG. 13 were obtained.

Also, in a state where the conductive element 113 has been arranged straight above the antenna element 112 and high radiation efficiency and a stable resonance frequency can be achieved according to the results of each of the simulation experiments described in the first embodiment (in a state in which the relative position Ha is approximately 5 mm at a facing position depicted on the left of FIGS. 3A and 3B), results such as those on the right side of the graph depicted in FIG. 13 were obtained from simulation experiments for deriving electromagnetic-wave radiation efficiency and a resonance frequency when the conductive element 113 has a linear shape and when the conductive element 113 is bent at the right angle and the tilt angle is set at 0° and 60° as depicted in FIGS. 12D and 12E.

According to the results of these simulation experiments, when the conductive element 113 has a bent shape by being bent in an inverted-C shape, high reception sensitivity substantially equivalent to that when the conductive element 113 has a linear shape is obtained by setting the tilt angle at 60°.

Also, irrespective of the tilt angle of the bent-shaped conductive element 113, a substantially equivalent resonance frequency is achieved.

Next, a relation between a clearance of the antenna element 112 when arranged in the antenna device according to the present embodiment and electromagnetic-wave radiation efficiency is described.

FIGS. 14A, 14B, 14C and 14D are diagrams for describing parameters applied in simulation experiments in the antenna device according to the present embodiment.

Figure 14A:
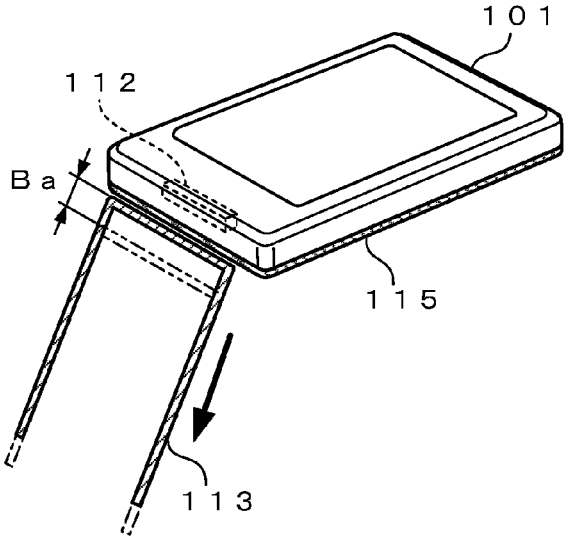
FIGS. 14A, 14B, 14C and 14D are diagrams for describing parameters applied in simulation experiments in the antenna device according to the second embodiment.
Figure 14B:
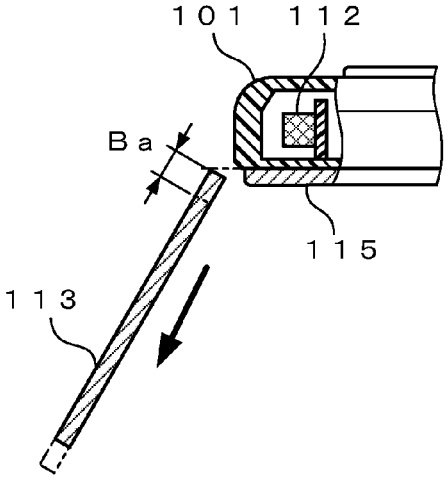

Here, FIGS. 14A and 14B are diagrams depicting a deviation from an initial position which is an optimum position where high radiation efficiency can be obtained when the conductive element according to the present embodiment is arranged in an arbitrary area at the end of the belt section and a stable resonance frequency can be achieved.

Figure 14C:
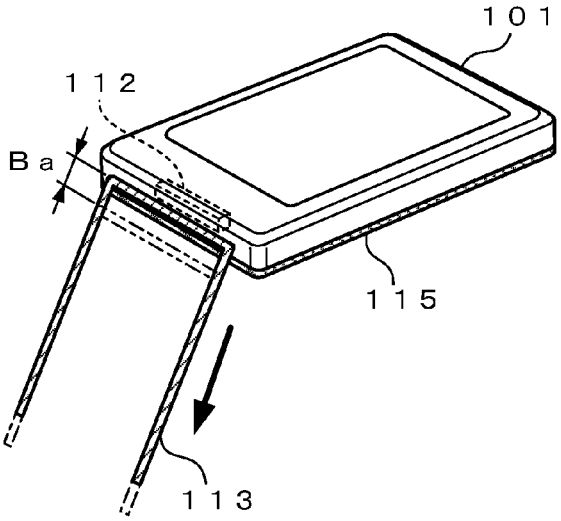
Figure 14D:
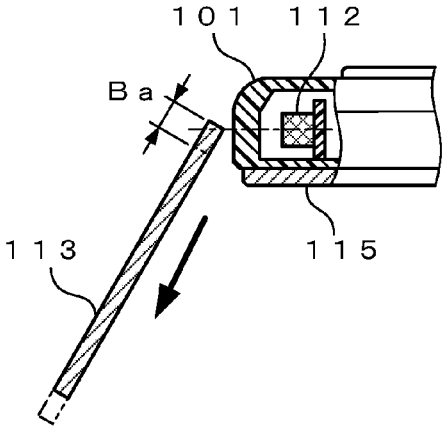

FIGS. 14C and 14D are diagrams depicting a deviation from an initial position which is an optimum position where high radiation efficiency can be obtained when the conductive element is arranged straight above the antenna element and a stable resonance frequency can be achieved.

Figure 15A:
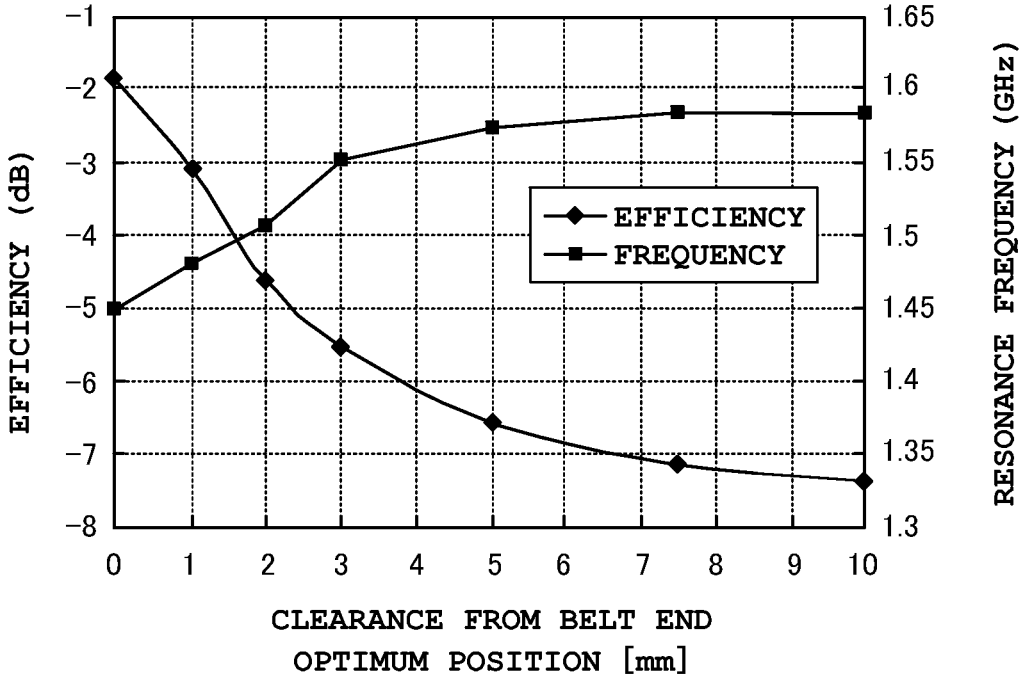
FIGS. 15A and 15B are diagrams depicting a relation (simulation results) between the arrangement of the conductive element and electromagnetic-wave radiation efficiency in the antenna device according to the second embodiment.
Figure 15B:
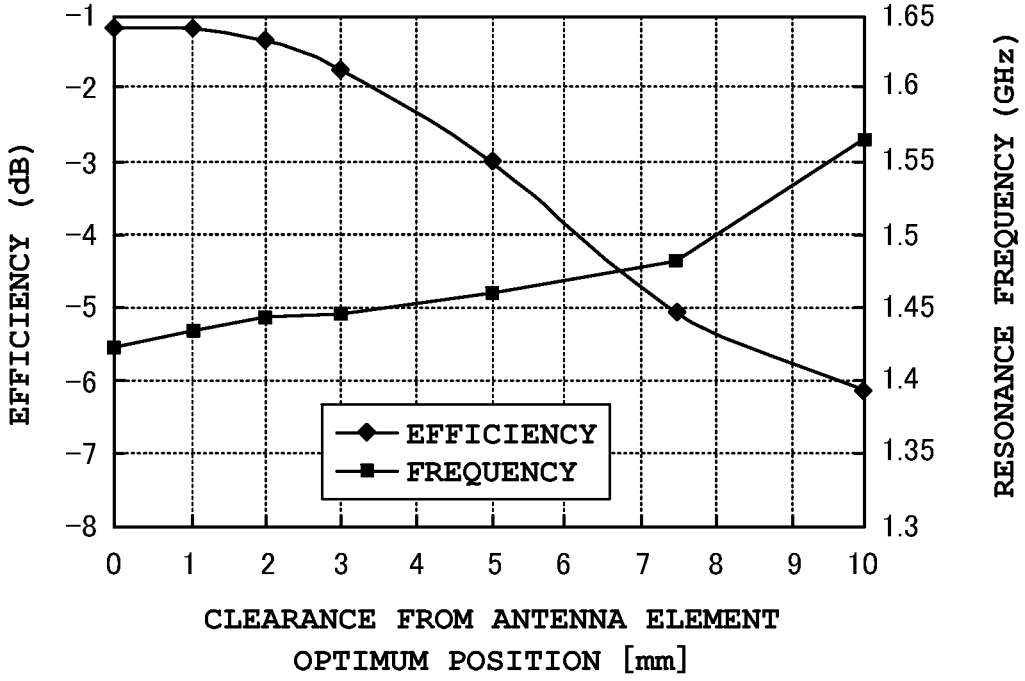

FIGS. 15A and 15B are diagrams depicting a relation (simulation results) between the arrangement of the conductive element in the antenna device according to the present embodiment and electromagnetic-wave radiation efficiency.

Here, FIG. 15A is a diagram depicting a relation between a displacement from the initial position (a distance from the optimum position where high radiation efficiency can be obtained and a stable resonance frequency can be achieved) and radiation efficiency, and a relation between the displacement and a resonance frequency, with the conductive element according to the present embodiment being arranged at the end of the belt section.

FIG. 15B is a diagram depicting a relation between a displacement from the initial position (a distance from the optimum position) and radiation efficiency, and a relation between the displacement and a resonance frequency, with the conductive element according to the present embodiment being arranged straight above the antenna element.

In a state where the conductive element 113 has been arranged at the end of the belt section 102 additionally provide to the housing 101 in a manner to face the antenna element 112 and the tilt angle has been set at 60°, results such as those depicted in FIG. 15A were obtained from simulation experiments for deriving electromagnetic-wave radiation efficiency with a frequency of 1.57542 GHz that is a frequency applied to GPS and a resonance frequency while the conductive element 113 is being moved in a direction moving away from the housing 101 at the above-described tilt angle and a displacement Ba from the initial position is being changed as depicted in FIGS. 14A and 14B.

According to the results, the radiation efficiency tends to significantly decrease as the displacement Ba increases (that is, as the conductive element 113 is moved away from the housing 101).

Also, the resonance frequency tends to be approximately stabilized when the displacement Ba is set approximately equal to or larger than 3 mm.

Also, in a state where the conductive element 113 has been arranged straight above the antenna element 112 and the tilt angle has been set at 60°, results such as those depicted in FIG. 15B were obtained from simulation experiments for deriving electromagnetic-wave radiation efficiency with the same conditions and a resonance frequency while the conductive element 113 is being moved in a direction moving away from the housing 101 at the above-described tilt angle and the displacement Ba from the initial position is being changed as depicted in FIGS. 14C and 14D.

According to the results, relatively high radiation efficiency can be obtained when the displacement Ba is set relatively low (approximately equal to or smaller than 3 mm) and radiation efficiency tends to decrease as the displacement Ba increases.

Also, the resonance frequency tends to be stabilized as the displacement Ba increases.

Note that, although not depicted in the drawing, the inventors have confirmed from similar simulation experiments that, by setting the shape of the conductive element as an inverted-C shape or a shape analogous thereto (that is, any plane shape in which a side for receiving an electromagnetic wave from the antenna element 112 and a side for radiating the excited electromagnetic wave form approximately the right angle; refer to FIGS. 11C to 11E) based on the wavelength of an electromagnetic wave transmitted or received by the antenna element 112, approximately high radiation efficiency and a stable resonance frequency tend to be obtained.

Therefore, by appropriately setting the arrangement and the tilt angle of the conductive element with respect to the antenna element and the shape and dimension (length) of the conductive element based on the results of each of the above-described simulation experiments, an antenna device capable of resonating with a specific frequency of an electromagnetic wave transmitted or received by the antenna element so as to favorably resonate with the electromagnetic wave of the specific frequency can be achieved.

Next, radiation characteristics of the antenna device according to the present embodiment are described by using a conductive element whose arrangement, tilt angle, shape, and dimensions have been set so as to achieve high radiation efficiency and a stable resonance frequency based on the results of the simulation experiments described above.

Here, comparison and verification are made by using a structure in which conductive element according to the present embodiment is not included in the belt section 102 additionally provided to the housing 101 (hereinafter referred to as a "comparative example").

Figure 16C:
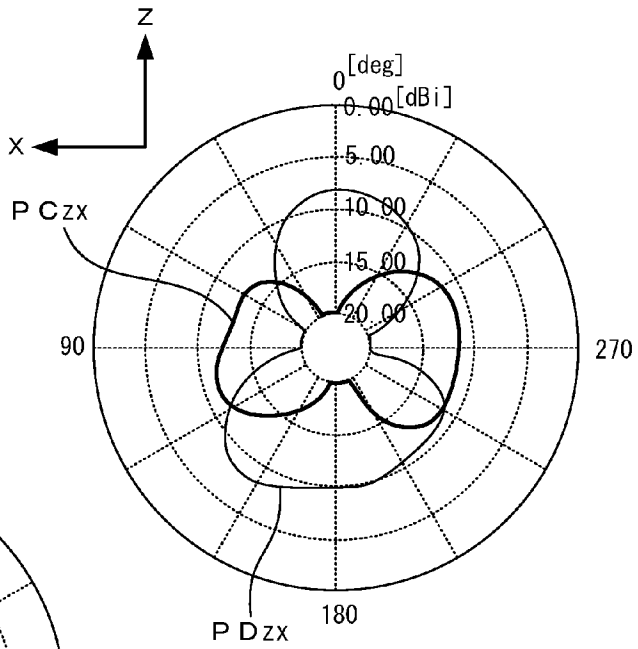
FIGS. 16A, 16B and 16C are diagrams depicting radiation characteristics in an antenna device serving as a comparative example for the second embodiment (measurement results)
Figure 16B:
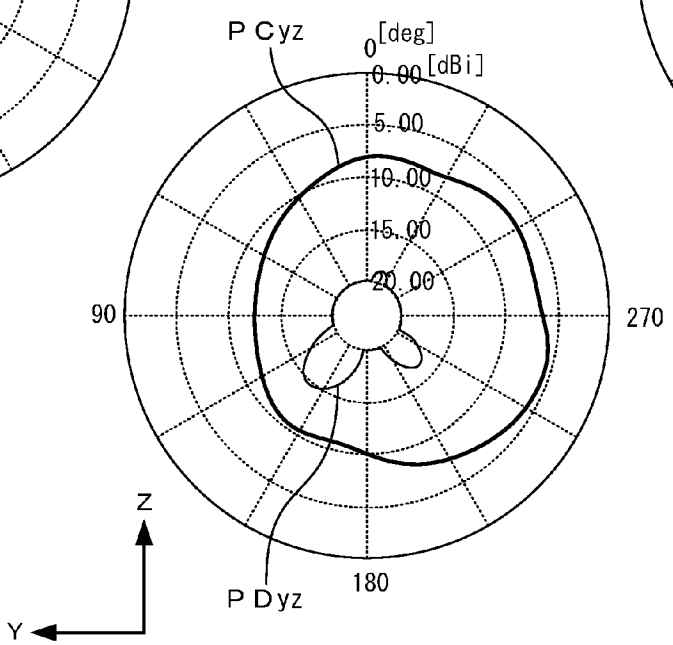
Figure 16A:
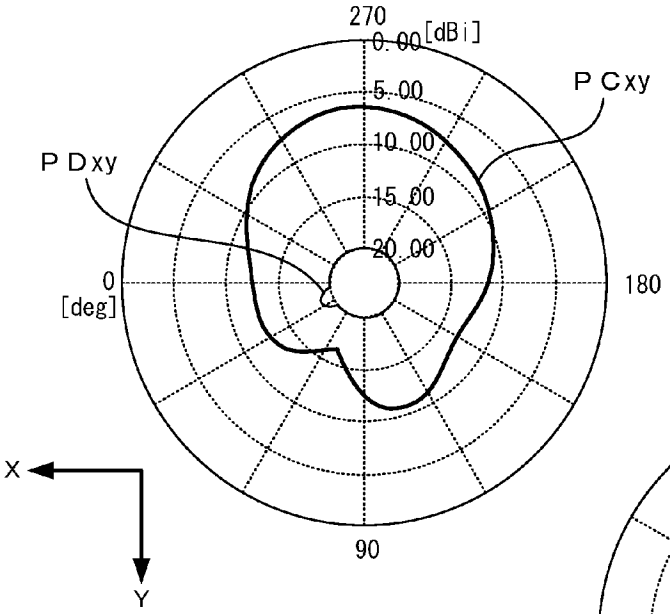

FIGS. 16A, 16B and 16C are diagrams depicting radiation characteristics in an antenna device serving as a comparative example for the present embodiment (simulation results).

Figures 17A, 17B, 17C:
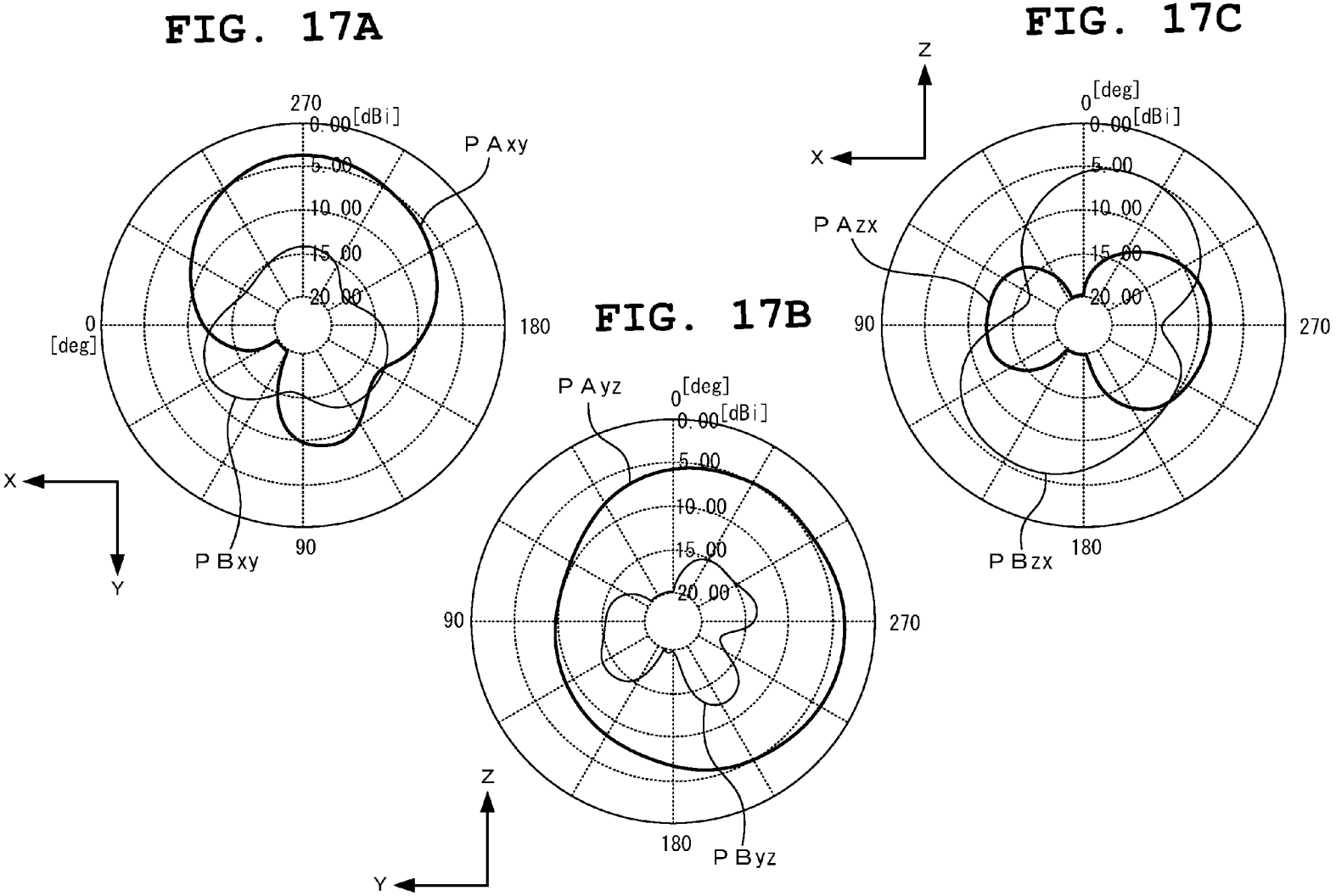
FIGS. 17A, 17B and 17C are diagrams depicting radiation characteristics in the antenna device according to the second embodiment (simulation results)

FIGS. 17A, 17B and 17C are diagrams depicting radiation characteristics in the antenna device according to the present embodiment (simulation results).

First, electromagnetic-wave radiation characteristics in the comparative example where the conductive element 113*f* is not provided to the belt section 102 additionally provided to the housing 101 in the above-described electronic device 1008 are described.

In the comparative example, as a result of measuring radiation characteristics when an electromagnetic wave having a frequency of 1.57542 GHz (approximately 1.6 GHz) that is a frequency applied to GPS was transmitted or received by using a linear-polarization-type antenna element, radiation patterns such as those depicted in FIGS. 16A to 16C were obtained.

Also, an average gain in the comparative example obtained from the simulation experiment was −8.775 dBi.

Here, the comparative example is described with reference to the electronic device 1008 depicted in FIG. 10A. FIG. 16A depicts a radiation pattern on an X-Y plane including one plane (an upper surface in the drawing) where the display section 111 has been provided on the housing 101.

Here, with the center of the plane shape of the one surface of the housing 101 as a reference point, a radiation pattern on an X-Y plane when a direction in which the belt section 102 provided with the conductive element 113*f* is additionally provided (the frontward direction of FIG. 10A; the six o'clock direction in the case of a wristwatch) is defined as an X-axis direction and a direction orthogonal to this X axis (the right direction of FIG. 10A; the nine o'clock direction in the case of a wrist watch) is defined as a Y-axis direction is depicted.

In FIG. 16A, a radiation pattern $PC_{xy}$ represents radiation components in all circumferential directions (0 to 360°) in the X-Y plane, and a radiation pattern $PD_{xy}$ represents radiation components projected onto the X-Y plane among radiation components in directions including a Z-axis direction (the downward direction of FIG. 10A; the wrist direction in the case of a wristwatch) orthogonal to the X-Y plane.

FIG. 16B depicts a radiation pattern in a Y-Z plane orthogonal to the X-Y plane (in the case of a wristwatch, a plane passing through the three o'clock-nine o'clock direction (Y axis) and orthogonal to the X-Y plane) in the housing 101.

Here, in FIG. 16B, a radiation pattern $PC_{yz}$ represents radiation components in all circumferential directions in the Y-Z plane, and a radiation pattern $PD_{yz}$ includes radiation components projected onto the Y-Z plane among radiation components in directions including the X-axis direction orthogonal to the Y-Z plane.

FIG. 16C depicts a radiation pattern in a Z-X plane orthogonal to the X-Y plane (in the case of a wristwatch, a plane passing through the six o'clock-twelve o'clock direction (X axis) and orthogonal to the X-Y plane) in the housing 101.

Here, in FIG. 16B, a radiation pattern $PC_{zx}$ represents radiation components in all circumferential directions in the Z-X plane, and a radiation pattern $PD_{zx}$ includes radiation components projected onto the Z-X plane among radiation components in directions including the Y-axis direction orthogonal to the Z-X plane.

By contrast, in the present embodiment where the arrangement, tilt angle, shape, and dimension of the conductive element 113*f* have been appropriately set on the belt section 102 additionally provided to the housing 101 so as to achieve high radiation efficiency and a stable resonance frequency based on the results of the simulation experiments, radiation patterns such as those depicted in FIGS. 17A to 17C were obtained as a result of a simulation experiment performed under the same conditions as those of the above-described comparative example.

Also, an average gain in the present embodiment obtained from the simulation experiment was −5.917 dB.

From above, it was found that the gain is significantly improved (by approximately 2.858 dBi) in the structure of the present embodiment as compared to the structure not provided with the conductive element 113*f* (comparative example).

FIG. 17A depicts a radiation pattern in the X-Y plane in the housing 101 of the electronic device 100B depicted in FIG. 10A.

Here, in FIG. 17A, a radiation pattern $PA_{xy}$ represents radiation components in all circumferential directions (0 to 360°) in the X-Y plane, and a radiation pattern $PB_{xy}$ represents radiation components projected onto the X-Y plane among radiation components in directions including the Z-axis direction orthogonal to the X-Y plane.

FIG. 17B depicts a radiation pattern in the Y-Z plane orthogonal to the X-Y plane in the housing 101.

Here, in FIG. 17B, a radiation pattern $PA_{yz}$ represents radiation components in all circumferential directions in the Y-Z planem, and a radiation pattern $PB_{yz}$ represents radiation components projected onto the Y-Z plane among radiation components in directions including the X-axis direction orthogonal to the Y-Z plane.

FIG. 17C depicts a radiation pattern in the Z-X plane orthogonal to the X-Y plane in the housing 101.

Here, in FIG. 17C, a radiation pattern $PA_{zx}$ represents radiation components in all circumferential directions in the Z-X plane, and a radiation pattern $PB_{zx}$ represents radiation components projected onto the Z-X plane among radiation components in directions including the Y-axis direction orthogonal to the ZX plane.

<Third Embodiment>

Next, a third embodiment of the electronic device in which the antenna device according to the present invention has been applied is described.

Figure 18A:
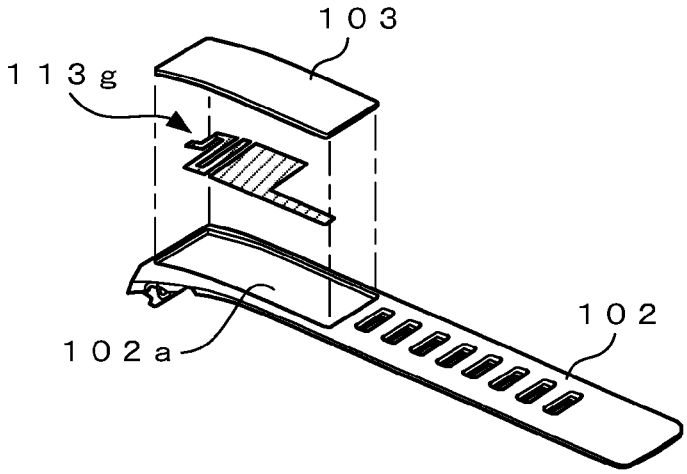
FIGS. 18A, 18B and 18C are schematic structural diagrams depicting a conductive element applied in an electronic device according to a third embodiment.
Figure 18B:
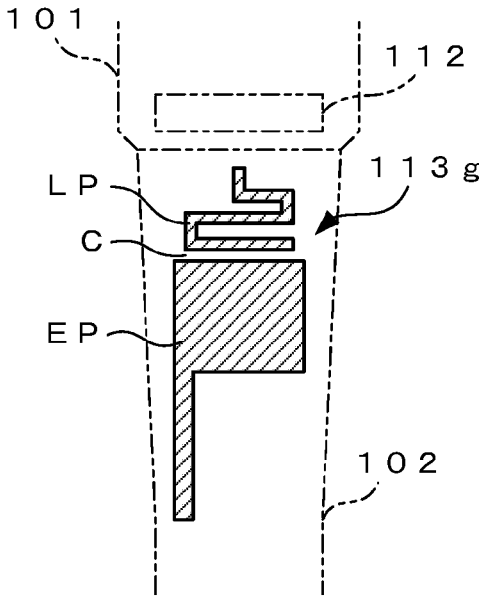
Figure 18C:
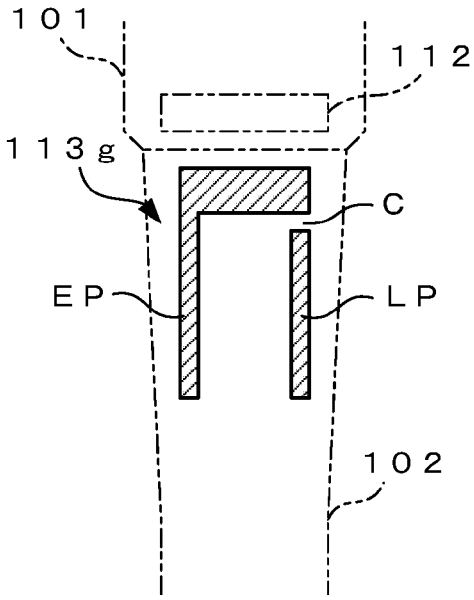

FIGS. 18A, 18B and 18C are schematic structure diagrams depicting a conductive element applied in the electronic device according to the third embodiment.

Here, FIG. 18A is a schematic view depicting the mounting of the conductive element to a belt section.

FIGS. 18B and 18C are schematic views depicting a plane shape of the conductive element.

Note that sections equivalent to those in the above-described embodiments are provided with the same reference numerals for simplification of description.

In the above-described second embodiment, the conductive element 113*f* is singly provided to the belt section 102 additionally provided to the housing 101 of the electronic device 100B.

In the third embodiment, an inductance component (L) and a capacitance component C are included in the belt section 102.

Specifically, as with the second embodiment, the electronic device according to the third embodiment includes the belt section 102 for mounting the housing 101 on a wrist, and has a structure where a conductive element 113*g*, which has a predetermined plane shape and is electromagnetically coupled to the antenna element 112, has been provided in an arbitrary area of the belt section 102, as depicted in FIG. 18A.

Here, the conductive element 113*g* is formed of, for example, a conductive thin plate or thin film. Also, as with the second embodiment, the conductive element 113*g* is closed by the cover member 103 with it being accommodated in a recessed accommodating section 102*a* provided in the belt section 102, and thereby incorporated inside the belt section 102, as depicted in FIG. 18A. This conductive element 113*g* insulated from the surroundings, and serves as a parasitic element not supplied with electric power from outside.

Note that the method for incorporating the conductive element 113*g* is not limited to that depicted in FIG. 18A. Alternatively, it is possible to apply the method of coating the front surface of the belt section 102 with a conductive coating material, or the method of laminating a conductive thin film, as described above. Still alternatively, metal deposition, sputtering, or the like may be applied to form the conductive element 113*g*. Still alternatively, the conductive element 113*g* may be integrally formed on the belt section 102 by using insert molding, two-color molding, or the like.

Also the conductive element 113*g* is structured to include, for example, a conductive pattern EP and a conductive pattern LP arranged in a manner to be spaced a predetermined distance away from the conductive pattern EP, as depicted in FIGS. 18B and 18C.

Here, as with the conductive element 113*f* described in the second embodiment, the plane shape (in particular, the length of a transmission path formed of the sides Sa and Sb described above; transmission path length) of the conductive pattern EP has been set such that the conductive pattern EP is electromagnetically coupled to the antenna element 112 and functions as a wave director.

Also, the plane shape of the conductive pattern (inductor-specific conductive member) LP is set such that the conductive pattern LP functions as an inductance (an induction line).

For each of the conductive pattern (capacitor-specific conductive member) EP and the conductive pattern LP, the plane shape, the length of facing sides, and clearance are set such that a capacitance (capacity line) having a predetermined capacity is formed between a space portion between the conductive patterns EP and LP.

Note that the plane shape of the conductive element 113*g* is not limited to those depicted in FIGS. 18B and 18C, and any plane shape may be applied as long as desired radiation characteristics can be achieved by the conductive element 113*g*.

According to the electronic device including the above-described antenna device, the conductive element 113*g* having an LC resonance circuit incorporated therein can be arranged on the belt section 102 such that it faces the antenna element 112 incorporated in the housing 101. Therefore, the design flexibility of each conductive pattern forming the conductive element 113*g* can be enhanced.

Thus, according to the present embodiment, by appropriately designing a transmission line (such as a transmission path length, induction line, and capacity line), an antenna device having favorable radiation characteristics and supporting circular polarization and an antenna device capable of directivity control can be achieved, which can contribute to the achievement of high functionality of electronic devices.

Next, an improvement effect of the radiation characteristics in the present embodiment specifically described with reference to the results of simulation experiments.

Figure 19A:
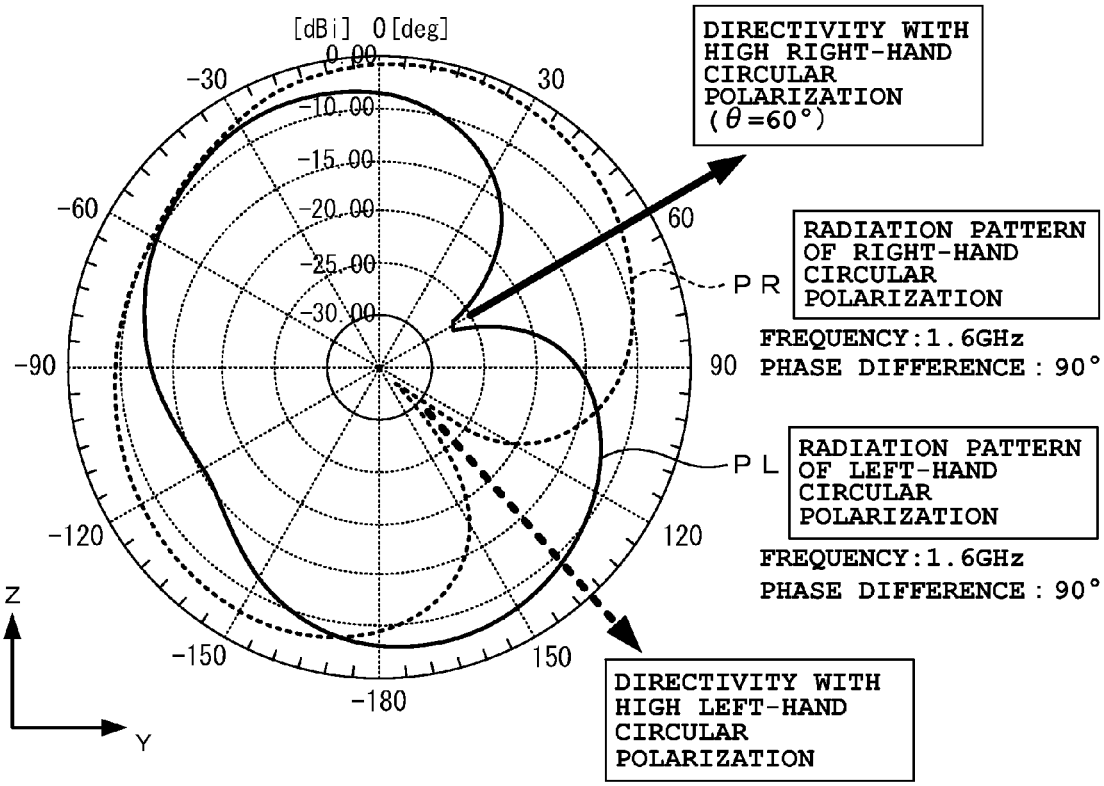
FIGS. 19A and 19B are diagrams depicting radiation characteristics in an antenna device according to the third embodiment.
Figure 19B:
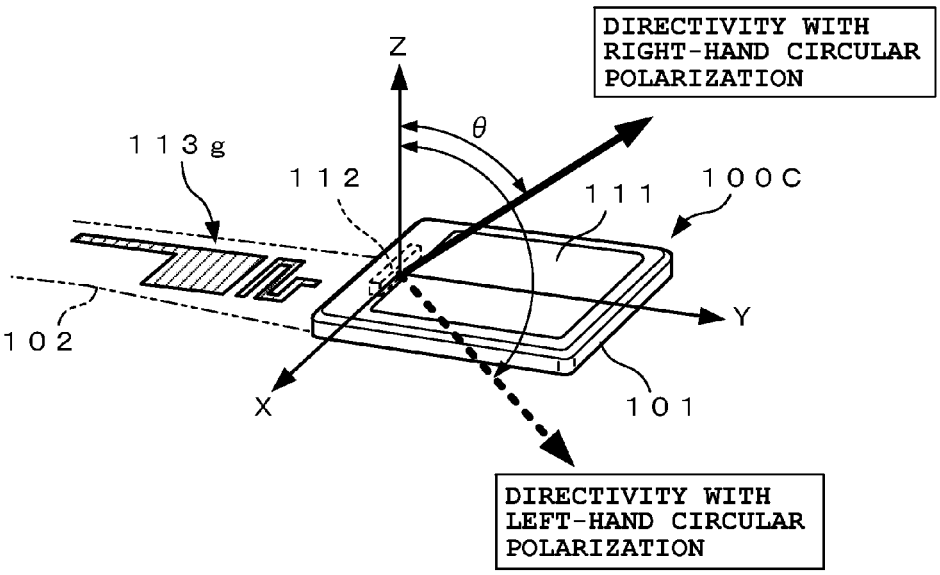

FIGS. 19A and 19B are diagrams depicting radiation characteristics in the antenna device according to the present embodiment (simulation results).

FIG. 19A is a diagram depicting the radiation characteristics in the antenna device according to the present embodiment.

FIG. 19B is a diagram depicting the directivity of circular polarization in the electronic device including the antenna device according to the present embodiment.

In the electronic device according to the present embodiment, as a result of a simulation experiment of radiating an electromagnetic wave having a frequency of approximately 1.57542 GHz (1.6 GHz) that is a frequency applied to GPS by using a linear-polarization-type antenna element, a radiation pattern such as that depicted in FIG. 19A was obtained.

Here, description is given with reference to an electronic device 100C depicted in FIG. 19B. FIG. 19A depicts a radiation pattern in a Y-Z plane orthogonal to an X-Y plane including one surface (upper surface in the drawing) of the housing 101 provided with the display section 111 (in the case of a wristwatch in FIG. 19B, a plane passing though the six o'clock-twelve o'clock direction (Y axis) and orthogonal to the X-Y plane: note that, for convenience of the simulation experiment, the coordinate axes are different from those depicted in FIG. 10A).

That is, with the center of the plane shape of the one surface of the housing 101 as a reference point, a radiation pattern on an Y-Z plane (a plane passing through the six o'clock-twelve o'clock direction (Y axis) and orthogonal to the X-Y plane in the case of the wristwatch) when the extending direction of the belt section 102 (the right direction of FIG. 19B; the twelve o'clock direction for the wristwatch) is defined as a Y-axis direction, a direction orthogonal to this Y axis (the frontward direction of FIG. 19B; the three o'clock direction for the wristwatch) is defined as an X-axis direction, and a direction orthogonal to the X-Y plane (the upper direction of FIG. 19B; a direction opposite to the wrist for the wristwatch) is defined as a Z-axis direction is depicted.

In FIG. 19A, a radiation pattern PR represents radiation components with respect to right-hand circular polarization in all circumferential directions ($\theta$=0 to 360°) in the Y-Z plane, and a radiation pattern PL represents radiation components with respect to left-hand circular polarization in all circumferential directions ($\theta$=0 to 360°) in the Y-Z plane.

In this simulation experiment, a transmission path length, induction line, and capacity line were set for the conductive pattern EP functioning as a wave director, the conductive pattern LP functioning as an inductance, and the space portion between the conductive patterns EP and LP functioning as a capacitance in the conductive element 113*g* depicted in FIGS. 18A, 18B, and 19B so that the phases of electromagnetic waves in the Y-Z plane are varied (shifted) by 90°.

From the results of this simulation experiment, it was found that a rotation angle $\theta$ from the Z axis to the Y-axis direction in the radiation components of the right-hand circular polarization has high directivity in a direction approximately at 60°, as depicted in FIGS. 19A and 19B.

In addition, it was found that the rotation angle $\theta$ in the radiation components of the left-hand circular polarization has high directivity in a direction approximately at 140°.

That is, by appropriately designing the transmission path length, inductance line, and capacity line forming the conductive element 113*g* such that the phase difference of an electromagnetic wave radiated from the antenna element 112 is set at 90°, circular polarization with favorable directivity can be generated by using a chip antenna for linear polarization.

Here, by designing the antenna device according to the present embodiment such that a direction in which right-hand circular polarization has high directivity ($\theta$=60°) is oriented to the sky as depicted in FIG. 19B when the user is viewing the display section 111 with the electronic device 100C being worn on his or her wrist, an electromagnetic wave (right-hand circular polarization) transmitted from a GPS satellite can be favorably received with a simple and small-sized structure.

Note that, when the user is viewing the display section 111 with the electronic device 100C being worn on the wrist, the right-hand circular polarization has high directivity in the sky direction, while the left-hand circular polarization has high directivity approximately in the ground direction, as depicted in FIG. 11A.

Here, since this left-hand circular polarization is unnecessary circular polarization for GPS and the direction of directivity is the human body direction, the left-hand circular polarization does not affect the radiation characteristics of the antenna device to be applied for GPS.

As such, according to the present embodiment, an antenna device having favorable radiation characteristics with a simple and small-sized structure and supporting desired circular polarization, and an antenna device capable of directivity control can be achieved.

<Modification Example of Third Embodiment>

Next, a modification example of the third embodiment is described.

Figure 20A:
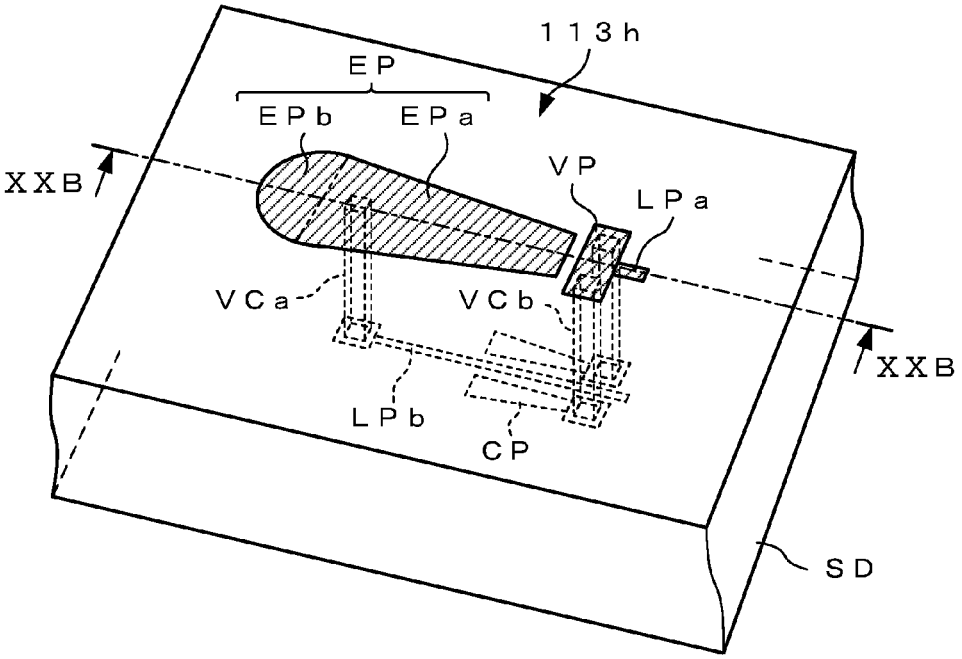
FIGS. 20A and 20B are schematic structural diagrams depicting a modification example of the conductive element applied in the electronic device according to the third embodiment.
Figure 20B:
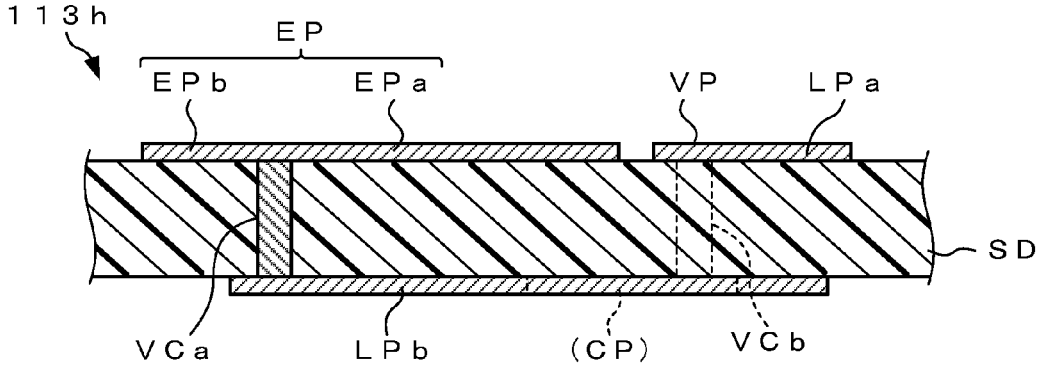

FIGS. 20A and 20B are schematic structure diagrams depicting a modification example of the conductive element applied in the electronic device according to the third embodiment.

Here, FIG. 20A is a perspective view of a schematic structure of the conductive element according to the present embodiment.

FIG. 20B is a schematic diagram depicting a sectional structure of the conductive element taken along line XXB-XXB in FIG. 20A (for convenience of description, "XX" is used herein as a sign corresponding to a Roman numeral of "20" depicted in FIGS. 20A and 20B).

In FIG. 20A as well, the conductive element has been hatched for convenience so as to clarify the graphical representation for convenience of reference.

In the above-described first to third embodiments, the conductive element (113 and 113*a* to 113*g*) for the structure where an electromagnetic wave of a specific frequency is propagated is provided to the housing 110 of the electronic device (100A to 100C) or in an area facing the antenna element 112 provided inside the housing 101.

In the modification example of the present embodiment, conductive elements for a structure where electromagnetic waves of a plurality of frequencies are propagated are provided.

Here, for these conductive elements, the structure of the antenna device described in, for example, Japanese Patent Application Laid-Open (Kokai) Publication No. 2011-176495, can be favorably applied.

The modification example of the conductive element according to the present embodiment has a multilayered structure including, for example, an insulating substrate SD functioning as a dielectric, conductive patterns EP (EPa and EPb), LPa, and VP provided on one surface side (the upper surface side in the drawing) of the insulating substrate SD, conductive patterns LPb and CP provided on the other surface side (the lower surface side in the drawing) of the insulating substrate SD, and vias VCa and VCb electrically connecting the conductive pattern EP and the conductive pattern LPb and the conductive pattern VP and the conductive pattern CP, as depicted in FIGS. 20A and 20B.

The conductive pattern EP is constituted by a conductive pattern EPa having a plane shape of an isosceles trapezoid whose lower side (a side on the left in the drawing) is longer than its upper side (a side on the right in the drawing and a conductive pattern EPb having a plane shape of a semi-circle connected to the lower side of the conductive pattern EPa.

Also, the conductive pattern EP is electrically connected, at a predetermined position of the conductive pattern EPa, to the conductive pattern LPb provided on the other surface side of the insulating substrate SD via the via VCa penetrating through the insulating substrate SD in the thickness direction.

Each conductive pattern VP is arranged facing the upper side of the conductive pattern EPa, and electrically connected to the conductive pattern CP provided on the other surface side of the insulating substrate SD via the via VCb penetrating through the insulating substrate SD in the thickness direction. Also, the conductive pattern LPa is provided extending in the extending direction of the conductive pattern EP (the horizontal direction in the drawing), and one end side of the conductive pattern LPa is connected to the conductive pattern VP.

The conductive pattern CP is plurally provided facing the conductive pattern EP such that the conductive pattern LPb extending in the extending direction of the conductive pattern EP (the horizontal direction in the drawing) is interposed therebetween.

Here, the conductive pattern CP is arranged to be planarly superposed on the conductive pattern EP when the insulating substrate SD is viewed in a planar view.

In a conductive element 113*h* having the above-described structure, the conductive pattern EP functions as a wave director described in the third embodiment, and the conductive pattern LPa (inductor-specific conductive member) functions as an inductance (induction line) described in the third embodiment.

The conductive pattern (capacitor-specific conductive member) EP and the conductive pattern (capacitor-specific conductive member) CP facing each other via the insulating substrate SD form a capacitance (capacity line) described in the third embodiment.

As with the case described in the third embodiment, the conductive element 113*h* is provided in an arbitrary area of the belt section 102 such that it faces the antenna element 112 incorporated in the housing 101.

Here, in the conductive element 113*h*, a band-shaped (thin-plate-shaped) member forming the belt section 102 is applied as the insulating substrate SD, each conductive pattern is directly formed on the front and rear surfaces of the belt section 102, and the conductive patterns on the front and rear surface sides are electrically connected via the vias, whereby the conductive element 113*h* is integrally incorporated into the belt section 102.

Note that, by having a structure in which each of the above-described conductive patterns is formed on both sides of the thin-plate-shaped or film-shaped insulating substrate SD, the conductive element 113*h* may be accommodated in the accommodating section 102*a* of the belt section 102, closed by the cover member 103 in this state, and incorporated inside the belt section 102, as depicted in FIG. 18A.

By appropriately designing the transmission path length, induction line, and capacity line of each conductive pattern forming the conductive element 113*h* in this antenna device, an antenna device that operates with a plurality of resonance frequencies as described in Japanese Patent Application Laid-Open (Kokai) Publication No. 2011-176495 can be achieved.

Therefore, according to the electronic device including the antenna device of the present embodiment, an antenna device that has high design flexibility of an conductive element and favorable radiation characteristics in a simple and small-sized structure and capable of radiating electromagnetic waves having a plurality of frequencies by a single conductive element can be achieved, which contributes to the achievement of high functionality of electronic devices.

<Examples of Application of Antenna Device>

Next, examples of the application of the antenna device according to the present invention are described.

In the first embodiment, any of the conductive elements 113 and 113*a* to 113*e* is provided to the side surface of the housing 110 of the electronic device 100A.

In the second and third embodiments, any of the conductive elements 113*f* to 113*h* is provided to the belt section 102 additionally provided to the housing 101 of the wristwatch-type electronic devices 100B and 100C.

The antenna device according to the present invention not limited to the examples of application to the electronic device described in each of the above-described embodiments. As will be described below, a structure can be applied in which a conductive element has been provided to any of various products and components that are removably mounted and fixed onto an electronic device.

The electronic device herein to be applied to this structure is structured to be provided with an antenna element on or inside the housing, but no conductive element is provided to the housing, a side surface of the housing, or a member additionally provided to the housing.

FIGS. 21A, 21B and 21C and FIGS. 22A, 22B and 22C are schematic structural diagrams depicting other application examples of the electronic device in which the antenna device according to the present invention has been applied.

Note that a conductive element in FIGS. 21A to 21C and FIGS. 22A to 22C has also been hatched so as to clarify the graphical representation for convenience of reference.

Also, sections equivalent to those in the above-described embodiments are provided with the same reference numerals for simplification of description.

Figure 21C:
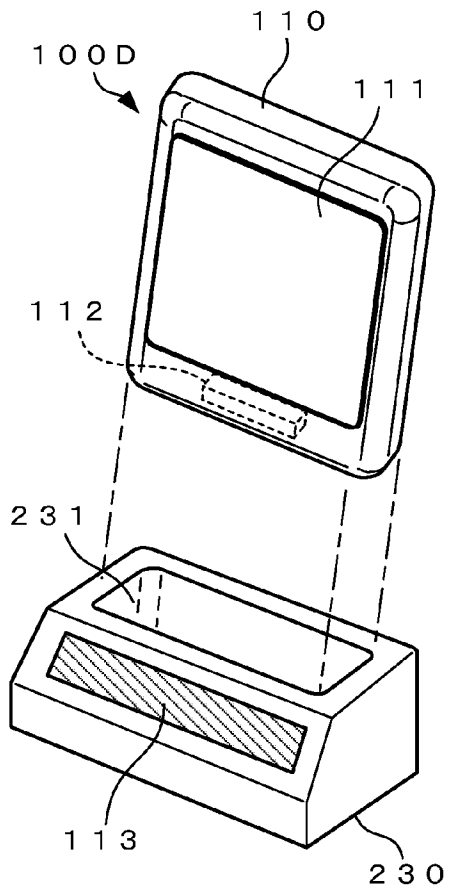
FIGS. 21A, 21B and 21C are schematic structural diagrams depicting a first set of other application examples of electronic devices in which the antenna device according to the present invention has been applied.
Figure 21B:
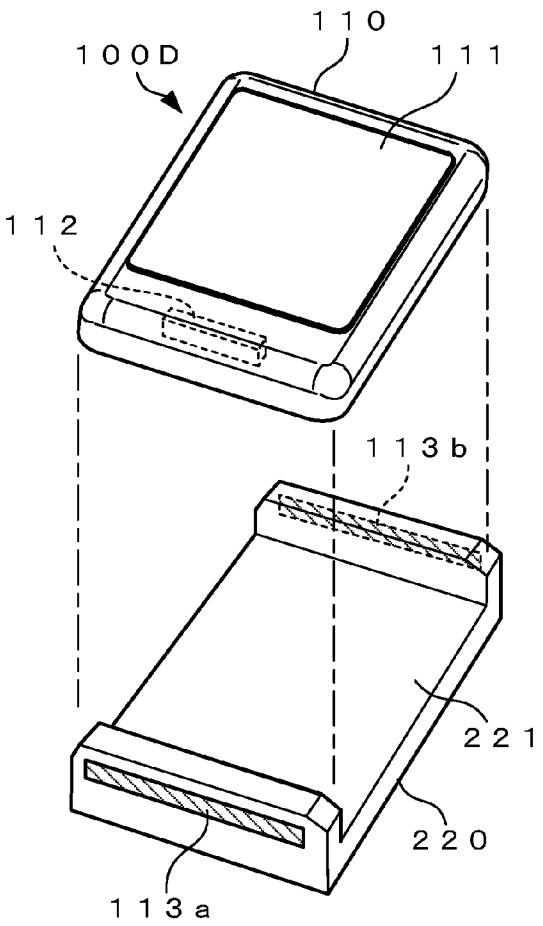
Figure 21A:
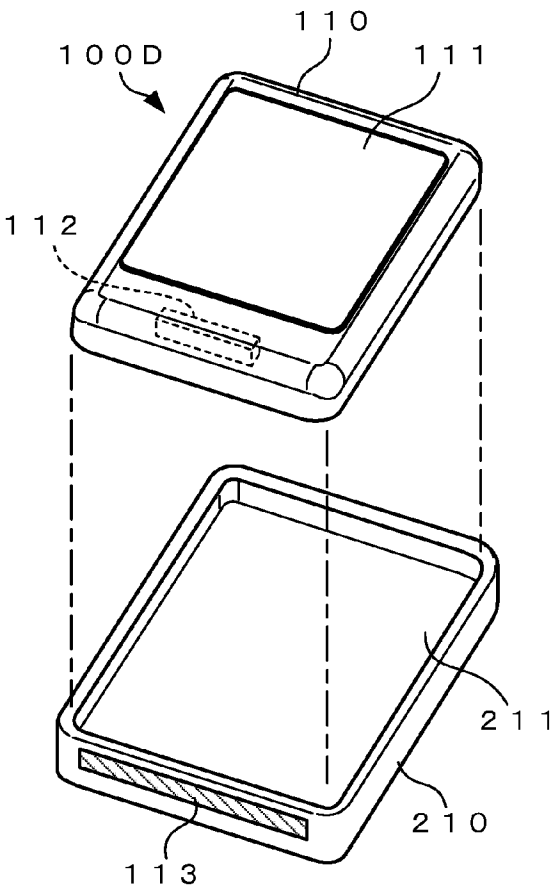

A first application example of the antenna device according to the present invention has a structure in which the conductive element 113 functioning as a wave director has been provided to a protective cover 210 for protecting the side surfaces and back surface (the lower surface side in the drawing) of an electric device 100D from outer impact, moisture, and the like, as depicted in FIG. 21A.

Here, the protective cover (holding member) 210 has a structure in which the conductive element 113 has been arranged on a side surface portion that comes close to and faces the antenna element 112 of the housing 110 with the electronic device 100D being mounted on the protective cover 210 for protection (fixedly fitted into a recessed portion 211).

Note that the conductive element 113, which is provided to the protective cover 210, may be individually provided to a plurality of side surface portions including the side surface portion of the protective cover 210 that comes close to and faces the antenna element 112, or may be continuously and integrally provided, as with the first embodiment (refer to FIGS. 8A to 8C and FIGS. 9A to 9C).

A second application example of the antenna device according to the present invention has a structure in which conductive elements 113*a* and 113*b* functioning as wave directors are provided in a recharge holder (a holder-type recharger; a holding member) 220 for recharging an internal battery (omitted in the drawing) of the electronic device 100D, as depicted in FIG. 21B.

Here, the recharge holder 220 has a structure in which the conductive elements 113*a* and 113*b* have been arranged in an area that comes close to and faces the antenna element 112 of the housing 110 and an area that faces the antenna element 112 across the electronic device 100D with the electronic device 100D being held in and fixed to a mount section 221.

Note that the conductive elements 113*a* and 113*b*, which are provided to the recharge holder 220, may be provided individually or continuously and integrally to a plurality of areas including an arbitrary area of the recharge holder 220 that comes close to and faces the antenna element 112, as with the first application example.

A third application example of the antenna device according to the present invention has a structure in which the conductive element 113 functioning as a wave director is provided to a recharge stand (a stand-type recharger; a holding member) 230 for recharging an internal battery (omitted in the drawing) of the electronic device 100D, as depicted in FIG. 21C.

Here, the recharge stand 230 has a structure in which the conductive element 113 has been arranged in an area that comes close to and faces the antenna element 112 of the housing 110 with the electronic device 100D being inserted into and fixed to a fitting section 231.

Note that the conductive element 113, which is provided to the recharge stand 230, may be provided individually or continuously and integrally to a plurality of areas including an arbitrary area of the recharge stand 230 that comes close to and faces the antenna element 112, as with the first and second application examples.

In the first to third application examples described above, the antenna device according to the present invention applied to the electronic device 1001) that has the structure in which the antenna element 112 has been arranged at a position close to a specific side surface (the side surface on the frontward side in FIGS. 21A, 21B and 21C) of the housing 110. However, the present invention is not limited thereto.

That is, in an electronic device where a conductive member such as a metal-made rear lid is not used on the rear surface side of the housing 110, an antenna element can be provided near the rear surface side of the housing 110.

Figure 22A:
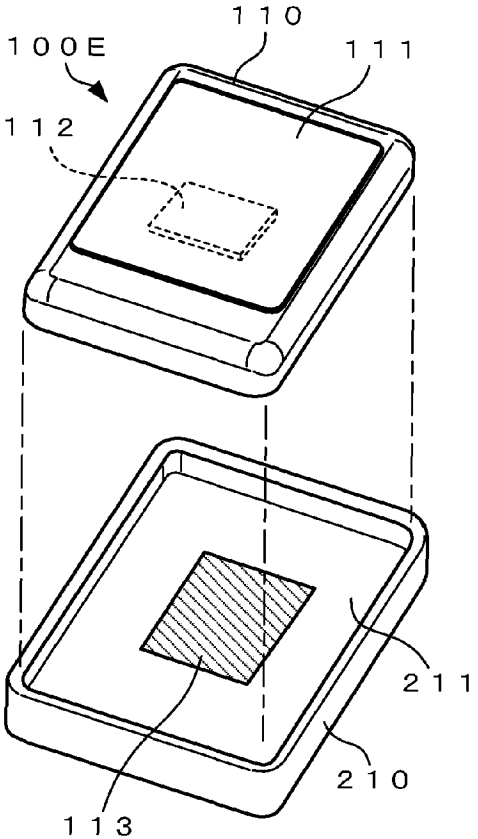
FIGS. 22A, 22B and 22C are schematic structural diagrams depicting a second set of other application examples of electronic devices in which the antenna device according to the present invention has been applied.

In the case of an electronic device having this structure, the protective cover 210 may have a structure in which the conductive element 113 has been arranged in an arbitrary area on the bottom surface of the recessed portion 211 that comes close to and faces the antenna element 112 of the housing 110 with the electronic device 100E being mounted on the protective cover 210, as depicted in FIG. 22A.

Figure 22B:
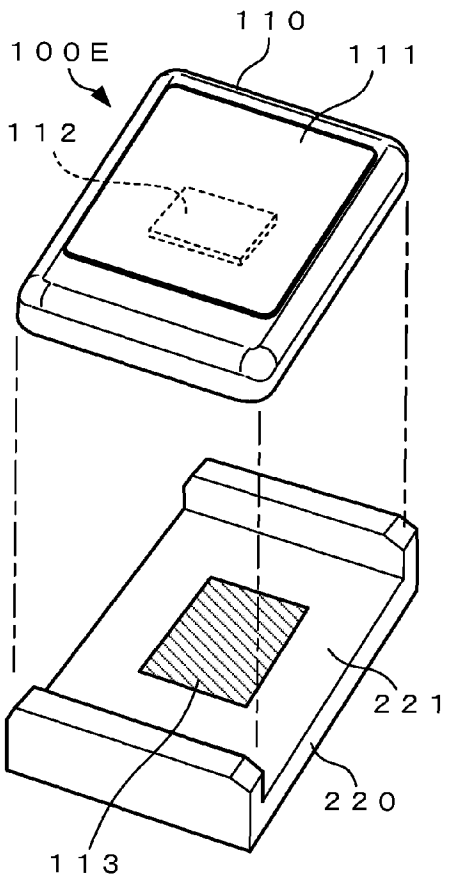

Also, the recharge holder 220 may have a structure in which the conductive element 113 has been arranged in an arbitrary area of the mount section 221 that comes close to and faces the antenna element 112 of the housing 110 with the electronic device 100E being held in and fixed to the mount section 221, as depicted in FIG. 22B.

Figure 22C:
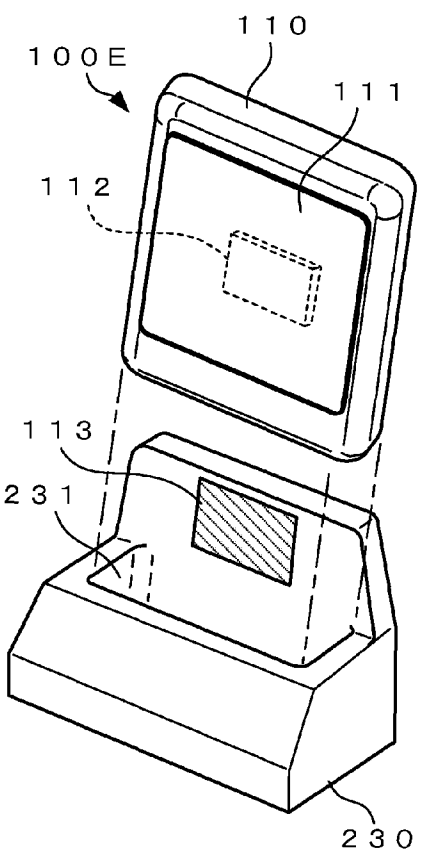

Moreover, the recharge stand 230 may have a structure in which the conductive element 113 has been arranged in an arbitrary area of a back-surface support portion that comes close to and faces the antenna element 112 of the housing 110 with the electronic device 100E being inserted into and fixed to the fitting section 231, as depicted in FIG. 22C.

In the electronic device 100E where the antenna device having the above-described structure has been applied, the electromagnetic-wave radiation characteristics (antenna characteristics) can be improved with the protective cover 210 being mounted and fixed or with the recharge holder 220 or the recharge stand 230 being mounted and fixed, as with the above-described embodiments.

Since the structure provided with the conductive element 113 can be applied to any of peripheral products and components such as the protective cover 210, the recharge holder 220, and the recharge stand 230 that are removably mounted and fixed to the housing 110 of the electronic device 100E, the need for providing a conductive element on the outer surface of the housing 110 of the electronic device 100E can be eliminated, an existing electronic device not provided with a conductive element on the housing or the belt section can be directly applied, and the design flexibility of conductive elements can be enhanced.

Also, since the structure of the antenna device according to the present invention can be incorporated into any of various peripheral products and components mounted to the housing 110, the design flexibility of conductive elements and the convenience of electronic devices can be increased, and electromagnetic-wave radiation characteristics can be improved by a simple structure.

While the present invention has been described with reference to the preferred embodiments, it is intended that the invention be not limited by any of the details of the description therein but includes all the embodiments which fall within the scope of the appended claims.

What is claimed is:

1. An antenna device comprising:

an antenna element which transmits or receives an electromagnetic wave having a specific frequency by being supplied with electric power;

a conductive element which is a parasitic element;

a housing; and a first mount member and a second mount member which are mounted to the housing, wherein the antenna element is provided inside the housing, wherein the conductive element is provided only inside one of the first mount member and the second mount member, and wherein the conductive element is electromagnetically coupled to the antenna element without being galvanically connected with other components, resonates with the specific frequency, and transmits or receives the electromagnetic wave, wherein said one of the first mount member and the second mount member includes a recessed accommodating section, wherein the conductive element is provided inside said one of the first mount member and the second mount member by being accommodated in the recessed accommodating section, the recessed accommodating section being closed by a cover member made of a same insulating material as that of said one of the first mount member and the second mount member, and wherein each of the first mount member and the second mount member is a belt for mounting the antenna device to an object.

2. The antenna device according to claim 1, wherein the conductive element is arranged so as to be spaced apart from and face the antenna element.

3. The antenna device according to claim 1, wherein each of the first mount member and the second mount member is formed of an insulating material.

4. The antenna device according to claim 1, wherein the conductive element has a first side and a second side each having a linear shape, and wherein the first side and the second side cross each other.

5. The antenna device according to claim 4, wherein the conductive element is arranged so as to be spaced apart from and face the antenna element, wherein the first side is a side facing the antenna element and a length of the first side is 1/8 of a wavelength of the specific frequency, and wherein a length of the second side is 1/4 of the wavelength of the specific frequency.

6. The antenna device according to claim 1, wherein the conductive element includes a first conductive pattern and a second conductive pattern spaced apart from the first conductive pattern, and wherein a capacitance is formed between a space portion between the first conductive pattern and the second conductive pattern.

7. The antenna device according to claim 1, wherein the first mount member is a first belt and the second mount member is a second belt.

* * * * *